US012693075B2

(12) United States Patent
Li et al.

(10) Patent No.: US 12,693,075 B2
(45) Date of Patent: Jul. 28, 2026

(54) FOG DISSIPATION DEVICE AND COOLING TOWER

(71) Applicant: SHANDONG BENO COOLING EQUIPMENT CO., LTD., Dezhou (CN)

(72) Inventors: Jin Peng Li, Dezhou (CN); Liang Cai Chen, Dezhou (CN); Zhen Xing Lin, Dezhou (CN); Jin Li, Dezhou (CN); Yan Liu, Dezhou (CN); Gang Sun, Dezhou (CN); Min Liu, Dezhou (CN); Juan Du, Dezhou (CN)

(73) Assignee: SHANDONG BENO COOLING EQUIPMENT CO., LTD., Dezhou (CN)

( * ) Notice: Subject to any disclaimer, the term of this patent is extended or adjusted under 35 U.S.C. 154(b) by 666 days.

(21) Appl. No.: 17/998,746

(22) PCT Filed: Nov. 17, 2020

(86) PCT No.: PCT/CN2020/129390
§ 371 (c)(1),
(2) Date: Nov. 14, 2022

(87) PCT Pub. No.: WO2022/007296
PCT Pub. Date: Jan. 13, 2022

(65) Prior Publication Data

US 2023/0235964 A1 Jul. 27, 2023

(30) Foreign Application Priority Data

Jul. 7, 2020 (CN) ..... 202010643659.4
Jul. 7, 2020 (CN) ..... 202021316998.3
Sep. 2, 2020 (CN) ..... 202021886314.3

(51) Int. Cl.
*F28C 1/16* (2006.01)
*F28F 25/12* (2006.01)

(52) U.S. Cl.
CPC ..... *F28C 1/16* (2013.01); *F28F 25/12* (2013.01)

(58) Field of Classification Search
CPC ..... F28C 1/16; F28F 25/12
(Continued)

(56) References Cited

U.S. PATENT DOCUMENTS 3,997,635 A * 12/1976 Hallgren ..... F28F 25/02 261/DIG. 11
6,247,682 B1 * 6/2001 Vouche ..... F28C 1/14 261/153
(Continued)

FOREIGN PATENT DOCUMENTS

CN 110006270 A 7/2019
CN 111895812 A 11/2020
(Continued)

OTHER PUBLICATIONS

English Machine Translation of KR 1020150047409 A (Year: 2015).*
(Continued)

*Primary Examiner* — Charles S Bushey
(74) *Attorney, Agent, or Firm* — HAUPTMAN HAM, LLP

(57) ABSTRACT

A fog dissipation device includes a first flow path and a second flow path which are stacked to exchange heat between a first air flow and a second air flow flowing from bottom to top; a first outflow port through which the first air flow flowing out of the first flow path is discharged to the upper side of the fog dissipation device; and a second outflow port through which the second air flow flowing out
(Continued)

of the second flow path is discharged to the upper side of the fog dissipation device, wherein the first outflow port and the second outflow port are alternately stacked. The fog dissipation device can play a role in water-saving fog dissipation.

42 Claims, 23 Drawing Sheets

(58) Field of Classification Search
USPC ..... 261/160, 161, DIG. 77
See application file for complete search history.

(56) References Cited

U.S. PATENT DOCUMENTS

2003/0070547 A1* 4/2003 Hubbard ..... F28F 25/00
261/DIG. 11
2015/0069643 A1* 3/2015 Mockry ..... F28C 1/00
261/146

FOREIGN PATENT DOCUMENTS

CN 214308242 U * 9/2021
CN 216011843 U * 3/2022
EP 2990748 A1 * 3/2016
KR 1020150047409 A * 5/2015
KR 1020190134351 A * 12/2019

OTHER PUBLICATIONS

English Machine Translation of KR 1020190134351 A (Year: 2019).*
English Machine Translation of CN 214308242 U (Year: 2021).*
English Machine Translation of CN 216011843 U (Year: 2022).*
International Search Report issued in International Patent Application No. PCT/CN2020/129390, mailed Apr. 9, 2021; 5 pgs.

* cited by examiner

2000

FOG DISSIPATION DEVICE AND COOLING TOWER

RELATED APPLICATIONS

The present application is a U.S. National Phase of International Application Number PCT/CN2020/129390, filed Nov. 17, 2020, and claims priority to Chinese Application Numbers CN 202010643659.4, filed Jul. 7, 2020, CN 202021316998.3, filed Jul. 7, 2020, and CN 202021886314.3, filed Sep. 2, 2020.

TECHNICAL FIELD OF THE INVENTION

The present invention relates to a cooling tower and particularly to a cooling tower having water-saving fog dissipation requirements.

BACKGROUND OF THE INVENTION

For a cooling tower in the prior art, an air mixing portion, a water collecting and fog trapping portion, a spray portion, a heat exchange portion, an air import portion and a water collecting portion are successively arranged in a main body of the cooling tower from the top down. An exhaust portion is arranged in an upper portion of the main body, and the exhaust portion includes a wind drum and a draught fan arranged in the wind drum. Water is sprayed from the spray portion to the heat exchange portion, and the heat exchange portion is formed by stacking a plurality of packing sheets. The sprayed water flows from the top down. On the other hand, air is sucked into the cooling tower from the air import portion in the lower portion of the cooling tower and then flows from the bottom up to exchange heat with the sprayed hot water, thereby cooling the hot water.

The air after exchanging heat with the water is discharged from the wind drum of the cooling tower. The discharged air is saturated wet air, which is mixed with cold air outside the tower, so that the temperature is lowered and the saturation humidity ratio is reduced. As a result, the saturated water vapor will be condensed to form fog. Particularly in winter at high latitude areas, the air discharged from the cooling tower will form dense fog and then form rain and snow, thereby resulting in adverse effects on the environment. More seriously, ice will be formed on the devices and the ground, resulting in freezing damage.

FIG. 2 shows the basic structure of the cooling tower in the prior art. The wet hot air in the cooling tower flows into n small-volume A channels in the rhombic module at a left elevation angle 45° from the large-volume A inlet tunnel below the module. After releasing heat and being cooled and condensed to water, the outgoing wet warm air continuously enters the A outlet tunnel at the left elevation angle 45° and is then converged into a wet warm air group A'. The dry cold wind enters the B channel of the module from the lower B tunnel, becomes dry warm wind after absorbing heat and then exits the module, enters the upper B tunnel and becomes a dry warm wind group B'. The wet warm air group A' and the dry warm wind group B' are gradually mixed. After they are mixed evenly, the humidity ratio is not saturated, thereby achieving the fog dissipation effect. However, there are still the following problems in the prior art.

If it is assumed that there are m rhombic modules, there may be roughly m/2 wet warm air groups A' and m/2 dry warm wind groups B', where each group has a width of 1 to 2 m and generally has a length of more than 10 m. Thus, it can be seen that each group has a large volume. To mix evenly, it is necessary to flow upward for a long distance, that is, it is necessary to provide a higher mixing space above the top corner of the module. As a result, for the cooling tower, the height is significantly increased, and the cost is also increased. However, the height is not increased when the old tower is rebuilt.

SUMMARY OF THE INVENTION

In view of the above problems, the present invention provides a fog dissipation device and a cooling tower, wherein, in the fog dissipation device, air after exchanging heat with water exchanges heat with external cold air that flows into the cooling tower and does not exchange heat with air, thereby achieving the water-saving fog dissipation effect.

In accordance with one aspect of the present invention, a fog dissipation device is provided, including: a first flow path and a second flow path which are stacked to exchange heat between a first air flow and a second air flow flowing from bottom to top; a first outflow port through which the first air flow flowing out of the first flow path is discharged to the upper side of the fog dissipation device; and, a second outflow port through which the second air flow flowing out of the second flow path is discharged to the upper side of the fog dissipation device, wherein the first outflow port and the second outflow port are alternately stacked.

Preferably, the width of the first outflow ports is approximately the same as that of the fog dissipation device, and the width of the second outflow ports is approximately the same as that of the fog dissipation device.

Preferably, the fog dissipation device includes first fog dissipation sheets and second fog dissipation sheets which restrict the formation of the first and second flow paths, wherein the first fog dissipation sheets and the second fog dissipation sheets are alternately stacked.

Preferably, the top edge of the fog dissipation device is a horizontal straight edge, or an inclined straight edge having a certain included angle with the horizontal direction.

Preferably, the top edge of the fog dissipation device is formed as a curved edge.

Preferably, the bottom of the fog dissipation device forms a sharp corner with a downward tip.

Preferably, the bottom of the fog dissipation device is formed horizontally.

Preferably, the width dimension of the fog dissipation device consists of two sections, and a first import portion communicated with the first flow path is formed in one section of the bottom width of the fog dissipation device; and, a second import portion communicated with the second flow path is formed in the other section of the bottom width of the fog dissipation device.

Preferably, the width of the bottom edge of the first import portion is the same as that of the bottom edge of the second import portion.

Preferably, the width of the bottom edge of the first import portion is different from that of the bottom edge of the second import portion.

Preferably, when the width of the bottom edge of the first import portion is less than that of the bottom edge of the second import portion, the included angle between the bevel edge of the first import portion on an outflow side is greater than the included angle between the bevel edge of the second import portion on the outflow side and a horizontal plane.

Preferably, when the width of the bottom edge of the first import portion is greater than that of the bottom edge of the second import portion, the included angle between the bevel edge of the first import portion on the outflow side is less than the included angle between the bevel edge of the second import portion on the outflow side and the horizontal plane.

Preferably, the thickness of the inflow port of the first import portion is greater than that of the outflow port of the first import portion; and, the thickness of the inflow port of the second import portion is greater than that of the outflow port of the second import portion.

Preferably, a first transition portion is formed between the first import portion and the first flow path; and, a second transition portion is formed between the second import portion and the second flow path.

Preferably, the thickness of the first transition portion gradually decreases from the inflow port to the outflow port; and, the thickness of the second transition portion gradually decreases from the inflow port to the outflow port.

Preferably, the thickness of the inflow port of the first transition portion is greater than that of the inflow port of the first flow path, and the thickness of the outflow port of the first transition portion is less than that of the outflow port of the first import portion; and, the thickness of the inflow port of the second transition portion is greater than that of the inflow port of the second flow path, and the thickness of the outflow port of the second transition portion is less than that of the outflow port of the second import portion.

Preferably, first connection portions folded from the outflow port of the first import portion to opposite directions are formed on the first fog dissipation sheets and the second fog dissipation sheets, and the first transition portion is formed between the first connection portions; second connection portions folded from the outflow port of the second import portion to opposite directions are formed on the first fog dissipation sheets and the second fog dissipation sheets, and the second transition portion is formed between the second connection portions; and, the first and second connection portions are formed to bend a substrate at least one time to form a concave-convex shape.

Preferably, at least one bending point is formed on the first connection portion, and in the first transition portion, the thickness between the bending points on the first fog dissipation sheets and the corresponding bending points on the second fog dissipation sheets is less than that of the inflow port of the first transition portion and greater than that of the outflow port of the first transition portion; and, at least one bending point is formed on the second connection portion, and in the second transition portion, the thickness between the bending points on the first fog dissipation sheets and the corresponding bending points on the second fog dissipation sheets is less than that of the inflow port of the second transition portion and greater than that of the outflow port of the second transition portion.

Preferably, the first connection portion is divided into two portions by the bending point on the first connection portion, and the included angle between the portion close to the inflow port of the first transition portion and the horizontal plane is greater than the portion close to the outflow portion of the second transition portion and the horizontal plane; and, the second connection portion is divided into two portions by the bending point on the second connection portion, and the included angle between the portion close to the inflow port of the second transition portion and the horizontal plane is greater than the portion close to the outflow portion of the second transition portion and the horizontal plane.

Preferably, in the first transition portion, a plurality of downflow grooves are formed on the first connection portions on the first fog dissipation sheets, and a plurality of downflow grooves are also formed on the first connection portions on the second fog dissipation sheets stacked with the first fog dissipation sheets; and/or, in the second transition portion, a plurality of downflow grooves are formed on the second connection portions on the first fog dissipation sheets, and a plurality of downflow grooves are also formed on the second connection portions on the second fog dissipation sheets stacked with the first fog dissipation sheets. Preferably, the inflow port of the first flow path is formed in one section of the bottom width of the fog dissipation device; and, the inflow port of the first flow path is formed in the other section of the bottom width of the fog dissipation device.

Preferably, the fog dissipation device has: a first flow guide structure for guiding the first air flow flowing from one section of the bottom width of the fog dissipation device to an approximately full width range of the fog dissipation device; and/or, a second flow guide structure for guiding the second air flow flowing from the other section of the bottom width of the fog dissipation device to the approximately full width range of the fog dissipation device.

Preferably, the fog dissipation device is divided into a plurality of independent first flow chambers by the first flow structure, and the plurality of first flow chambers occupy the approximately full width of the fog dissipation device; and/or, the fog dissipation device is divided into a plurality of independent second flow chambers by the second flow guide structure, and the plurality of second flow chambers occupy the approximately full width of the fog dissipation device.

Preferably, first slots for allowing the first air flow to pass therethrough are formed at bottom ends of the first flow chambers, and the rib spacing of the plurality of first slots gradually increases from the edge of one section of the width of the fog dissipation device to the center of the fog dissipation device in the width direction; and/or, second slots for allowing the second air flow to pass therethrough are formed at bottom ends of the second flow chambers, and the rib spacing of the plurality of second slots gradually increases from the edge of the other section of the width of the fog dissipation device to the center of the fog dissipation device in the width direction.

Preferably, a plurality of first flow guide ribs protruded to one side and a plurality of second flow guide ribs protruded to the other side are formed on the surfaces of the first fog dissipation sheets; and/or, third flow guide ribs that are protruded to one side and correspond to the second flow guide ribs and fourth flow guide ribs that are protruded to the other side and correspond to the first flow guide ribs are formed on the surfaces of the second fog dissipation sheets, wherein the first and second flow guide structures are formed in such a way that the tips of the first flow guide ribs are connected to the tips of the fourth flow guide ribs in a sealed manner and the tips of the second flow guide ribs are connected to the tips of the third flow guide ribs in a sealed manner.

Preferably, the first, second, third and fourth flow guide ribs include a plurality of first extension sections extending obliquely.

Preferably, the first, second, third and fourth flow guide ribs further include second extension sections bent upward from the first extension sections.

Preferably, the first, second, third and fourth flow guide ribs further include third extension sections bent downward from the bottom ends of the first extension sections.

Preferably, the upper end of the first flow guide structure extends upward to the first outflow port; and/or, the upper end of the second flow guide structure extends upward to the second outflow port.

Preferably, third flow guide structures are formed in the first flow guide chambers and/or the second flow guide chambers, and the third flow guide structures consist of a plurality of strip-shaped protrusions extending obliquely.

Preferably, a seal fit portion is formed on the edge of the fog dissipation device where no inflow/outflow port is formed, to form the first flow path and the second flow path.

Preferably, the seal fit portion is formed in such a way that: concave bent portions are formed the first fog dissipation sheets on one side, convex bent portions are formed on the second fog dissipation sheets on the other side, and the concave bent portions on the first fog dissipation sheets can be connected to the convex bent portions of the second fog dissipation sheets.

Preferably, the fog dissipation device further includes side sealing members, and the side sealing members are arranged on two side edges of the fog dissipation device to cover gaps between the first fog dissipation sheets and adjacent second fog dissipation sheets.

Preferably, buckling structures are formed on two side edges of the fog dissipation device, and the side sealing members are buckled and connected to the buckling structures.

Preferably, the buckling structures are formed in such a way that: first protruded strips protruded to one side are formed on two side edges of the first fog dissipation sheets, second protruded strips protruded to the other side are formed on two side edges of the second fog dissipation sheets, and groove structures matched with the first and second protruded strips are formed on the side sealing members.

Preferably, bottom sealing members for covering gaps between the first fog dissipation sheets and adjacent second fog dissipation sheets are arranged in one section or the other section of the bottom width of the fog dissipation device.

Preferably, at least one straight-through first mounting hole is formed on the first fog dissipation sheets, and at least one second mounting hole corresponding to the first mounting hole is formed on the second fog dissipation sheets stacked with the first fog dissipation sheets; first bumps are formed on one side of the first fog dissipation sheets in a stacking direction, second bumps are formed on one side of the second fog dissipation sheets in the stacking direction, and the outer surfaces of the first bumps are fitted with the inner surfaces of the first mounting holes; and, a mounting tube runs through the first bumps and the second bumps.

Preferably, the outer diameter of the first bumps extending in the stacking direction gradually decreases, and the outer diameter of the second bumps extending in the stacking direction gradually decreases.

In accordance with another aspect of the present invention, a cooling tower is provided, including the fog dissipation devices described above, the plurality of fog dissipation devices being arranged in a horizontal direction to form a fog dissipation portion of the cooling tower.

Preferably, two side edges of the fog dissipation devices are formed as concave-convex edges, which are meshed with the concave-convex edges of adjacent fog dissipation devices.

Preferably, partition plates are arranged on the lower side of the fog dissipation portion and on the bottom of each fog dissipation device, and the plurality of partition plates are separated to form a plurality of air flow tunnels.

Preferably, sealing members extending in the stacking direction are arranged at junctions of the fog dissipation devices with the partition plates.

In accordance with still another aspect of the present invention, a cooling tower is provided, including:

a main body, including an air inlet that is formed in a lower portion of the main body to allow external air to flow therein, and an exhaust portion that is formed in an upper portion of the main body to exhaust an air flow;

a heat exchange portion which is located between the air inlet and the exhaust portion;

a spray portion which is located above the heat exchange portion and used to spray a medium to the heat exchange portion;

a fog dissipation portion which is located above the spray portion, the fog dissipation portion including a fog dissipation device, the fog dissipation device including: a first flow path and a second flow path which are stacked to exchange heat between a first air flow and a second air flow flowing from bottom to top; a first outflow port through which the first air flow flowing out of the first flow path is discharged to the upper side of the fog dissipation device; and, a second outflow port through which the second air flow flowing out of the second flow path is discharged to the upper side of the fog dissipation device, wherein the first outflow port and the second outflow port are alternately stacked; and a cold wind inflow port which is formed below the fog dissipation portion, the cold wind inflow port being communicated with the first flow path in the fog dissipation device, the cold wind inflow port extending in the horizontal direction and running through at least one sidewall of an air chamber of the cooling tower to be communicated with external air;

wherein the first air flow flows into the first flow path from the cold wind inflow port, and the second air flow successively flows through the heat exchange portion and the spray portion and then into the second air flow from the air inlet.

Preferably, the cold wind inflow port includes a first valve on the sidewall of the air chamber of the cooling tower and a second valve located below the first valve; the cold wind inflow port is communicated with external air through the first valve; and, the cold wind inflow port is communicated with an internal space below the cold wind inflow port through the second valve.

Preferably, the second valve includes a first valve plate and a second valve plate, and the first valve plate and the second valve plate are pivoted at the cold wind inflow port;

wherein, when the second valve is closed, the first valve plate and the second valve plate form a sharp corner with a downward tip.

The fog dissipation device and the cooling tower according to the embodiments of the present invention have at least the following beneficial effects.

A first outflow port and a second outflow port stacked alternately are formed on the upper side of the fog dissipation device, so that a first air flow flowing out of the first outflow port and a second air flow flowing out of the second outflow port can be mixed evenly, thereby enhancing the fog dissipation effect.

DETAILED DESCRIPTION OF THE INVENTION

1000: cooling tower; 1010: main body; 1020: exhaust portion; 1021: wind drum; 1022: draught fan; 1100: air mixing portion; 1200: spray portion; 1300: heat exchange portion; 1400: air import portion; 1500: water collecting portion; 1600: fog dissipation portion; 1211: nozzle; 1700: cold wind inflow port; A: wet hot air tunnel; B: dry cold air tunnel; 1231: partition plate; A': wet warm air group; B': dry warm air group;

1601: fog dissipation device; C, C': first fog dissipation sheet; D, D': second fog dissipation sheet;

1601C: first flow path; 1601D: second flow path;

1610: first inflow port; 1620: second inflow port; 1630: functional portion; 1632: strip-shaped protrusion; 1640: first outflow port; 1650: second outflow port; 1633C, 1633D: first extension section; 1634C, 1634D: second extension section; 1637C, 1637D: third extension section;

2000: cooling tower; 2710: first valve; 2720: second valve; 2720A: first valve plate; 2721A: first portion; 2722A: second portion; 2720B: second valve plate; 2721*b*: third portion; 2722B: fourth portion;

3101: fog dissipation device;

3601C: first flow path; 3601D: second flow path;

3610: first inflow port; 3620: second inflow port; 3630: functional portion; 3640: first outflow port; 3650: second outflow port; 3660: buckling first import portion; 3670: second import portion; 3680: flared structure; 3681: first transition portion; LC, LD: first connection portion; ZC1, ZD1: first bending portion; ZCZC2, ZD2: second bending portion; 3682C, 3682D: groove;

C, C': first fog dissipation sheet; PC, PD: deflected portion; D, D': second fog dissipation sheet;

4601: fog dissipation device;

4601C: first flow path; 4601D: second flow path; 4610: first inflow port; 4620: second inflow port; 4630: functional portion; 4633C, 4633D: first extension section; 4634C, 4634D: second extension section; 4635C: first slot; 4635D: second slot; 4636C, 4636D: strip-shaped protrusion; 4637C, 4637D: third extension section; 4601: first import portion; 4670: second import portion;

5601: fog dissipation device;

5610: first inflow port; 5620: second inflow port; 5630: function portion; 5260: first import portion; 5670: second import portion; WC, WD: bent portion;

6601: fog dissipation device;

6637C: first mounting hole; 6637D: second mounting hole; 6638C: first bump; 6638D: second bump; 6639: mounting tube; 668: side sealing member; 6681: sealing fin; 6682: first sealing portion; 6683: second sealing portion; 6684: pull slot; 6685: first slot structure; 6686: second slot structure; 6687: first protruded strip; 6688: second protruded strip; 6689: bottom sealing member; and, 6690: sealing member.

DETAILED DESCRIPTION OF THE PRESENT INVENTION

The specific implementations of the present invention will be described below in detail with reference to the accompanying drawings.

First Implementation

Figure 1:
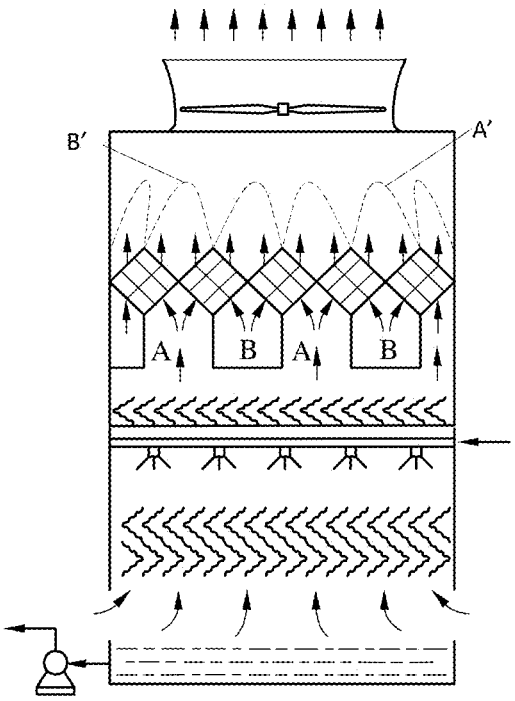
Fig. 1 Prior Art
FIG. 1 is a sectional elevation view of the cooling tower in the prior art.
Figure 2:
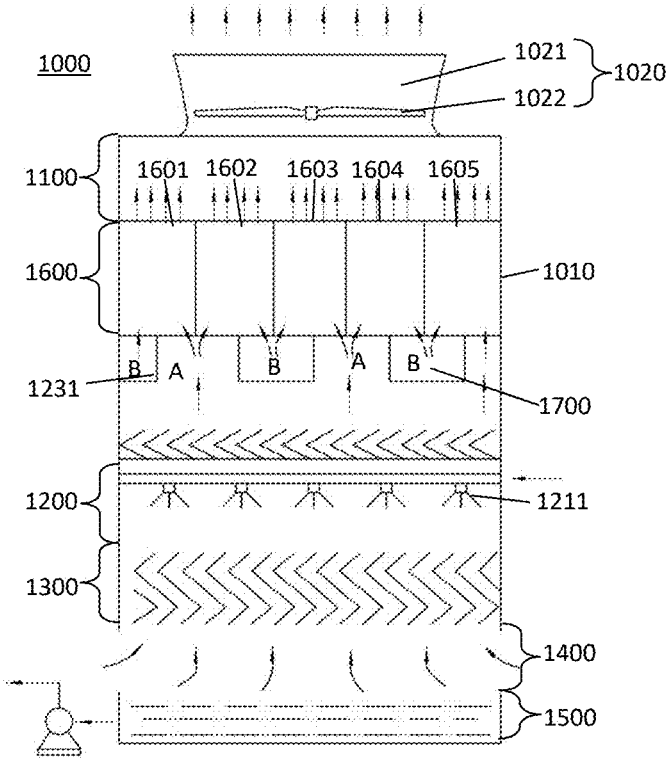
FIG. 2 is a sectional elevation view of the cooling tower according to an implementation of the present invention.
Figure 3:
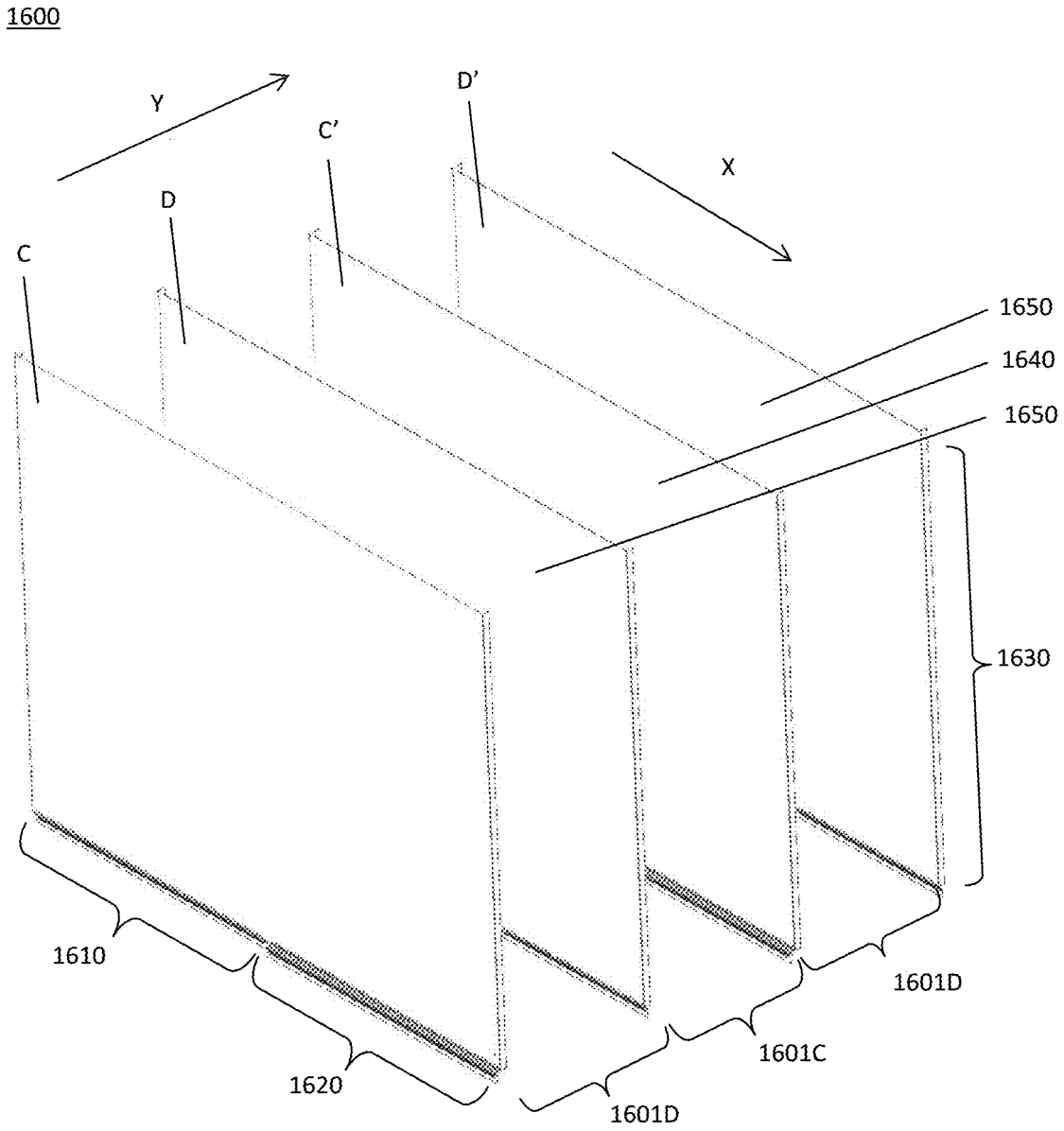
FIG. 3 is an exploded view of the fog dissipation device used in this embodiment.

FIGS. 1-4 show structure diagrams of portions in the cooling tower according to this implementation. FIG. 3 shows X and Y directions, where the X direction is the width direction of the fog dissipation device, and Y direction is the stacking direction of fog dissipation sheets, i.e., the thickness of the outflow air curtain and the outflow wind curtain, i.e., the length direction of the fog dissipation device.

FIG. 2 is a structure diagram of the cooling tower according to the first implementation of the present invention. As shown in FIG. 2, in a main body 1010 of the cooling tower 1000, an air mixing portion 1100, a fog dissipation portion 1600, a spray portion 1200, a heat exchange portion 1300, an air import portion 1400 and a water collecting portion 1500 are arranged from the top down. An exhaust portion 1020 is arranged in an upper portion of the main body 1010, and the exhaust portion 1020 includes a wind drum 1021 and a draught fan 1022 arranged in the wind drum 1021.

According to the cooling tower 1000, a plurality of nozzles 1211 in the upper portion of the spray portion 1200 spray hot water downward, and the hot water falls in the internal space of the spray portion 1200 to enter the heat exchange portion 1300. In the heat exchange portion, the hot water exchanges heat with cold air flowing from the bottom of the heat exchange portion 1300, then flows out from the bottom of the heat exchange portion 1300, falls into the water collecting portion 1500 through the air import portion 1400, and is collected on the bottom of the main body 1010 of the cooling tower 1000. The heat exchange portion 1300 may be a conventional packing sheet.

In this implementation, a plurality of partition plates 1231 arranged in parallel are arranged on the lower side of the fog dissipation portion 1600, and a plurality of wet hot air tunnels A and dry cold wind tunnels B are partitioned on the lower side of the fog dissipation portion 1601 by the plurality of partition plates.

Thus, the dry cold wind outside the tower flows into the fog dissipation portion 1600 through the dry cold wind tunnels B, and flows through the first flow paths of the fog dissipation devices 1601-1605 in the fog dissipation portion 1600 to the air mixing portion 1100. In the wet hot air tunnels A, the dry cold wind flowing from the air import portion 1400 flows through the heat exchange portion 1300 spraying hot water to come into contact and exchange heat with the hot water so as to form wet hot air. The wet hot air also flows upward to the second flow paths of the fog dissipation devices 1601-1605 and to the air mixing portion 1100 to mix with the dry cold wind. After being mixed, the wet hot air changes from a saturated state to an unsaturated state, and is then discharged from the cooling tower, so that the fog disappears and fog dissipation is realized.

In the fog dissipation devices 1601-1605, when the wet hot air in the second flow paths comes into contact with the cold surfaces of the first flow paths, condensed water droplets are formed on the surfaces of the second flow paths. These water droplets are resulted from the condensation of the wet hot air, resulting in the reduction of water vapor in the wet hot air. The condensed water droplets fall back to the water collecting portion 1500, thereby saving water. The fog dissipation portion 1600 includes a plurality of fog dissipation devices, and the plurality of fog dissipation devices are successively arranged in the horizontal direction. The functional portion 1630 is upright, and adjacent fog dissipation devices are closely jointed without any gap, so that the heat exchange area is large and the space utilization rate is high. In the process of descaling with washing water, the washing water can wash vertically down to the whole functional portion 1630 so as to remove all dirt. Thus, it is ensured that the fog dissipation devices have clean heat exchange surfaces, good heat exchange performance, efficient water condensation and efficient fog dissipation, and it is also ensured that the fog dissipation devices have small overflowing resistance and the cooling tower has small overflowing resistance and low operation energy consumption. If the density of both the dry warm wind and the wet warm air in the functional portion 1630 is smaller than the ambient air, the dry warm wind and the wet warm air in the functional portion 1630 will be affected by buoyancy, so that the upward movement of the dry warm wind and the wet warm air is facilitated. The flow channel of the functional portion 1630 is vertical, and the flowing direction of the dry warm wind and the wet warm air is consistent with the direction of the buoyancy, so that the buoyancy effect can be fully exerted, the suction force reacquired by the draught fan 1022 can be relatively reduced, and it is advantageous for the reduction of the operation energy consumption. The side edges of the fog dissipation devices 1601-1605 may be straight edges, which are closely fitted with the side edges of adjacent fog dissipation devices without any gap, so that the space is fully utilized.

The fog dissipation device in this implementation will be described below by taking the fog dissipation device 1601 (any one of the fog dissipation devices 1601-1605) as an example.

Figure 4:
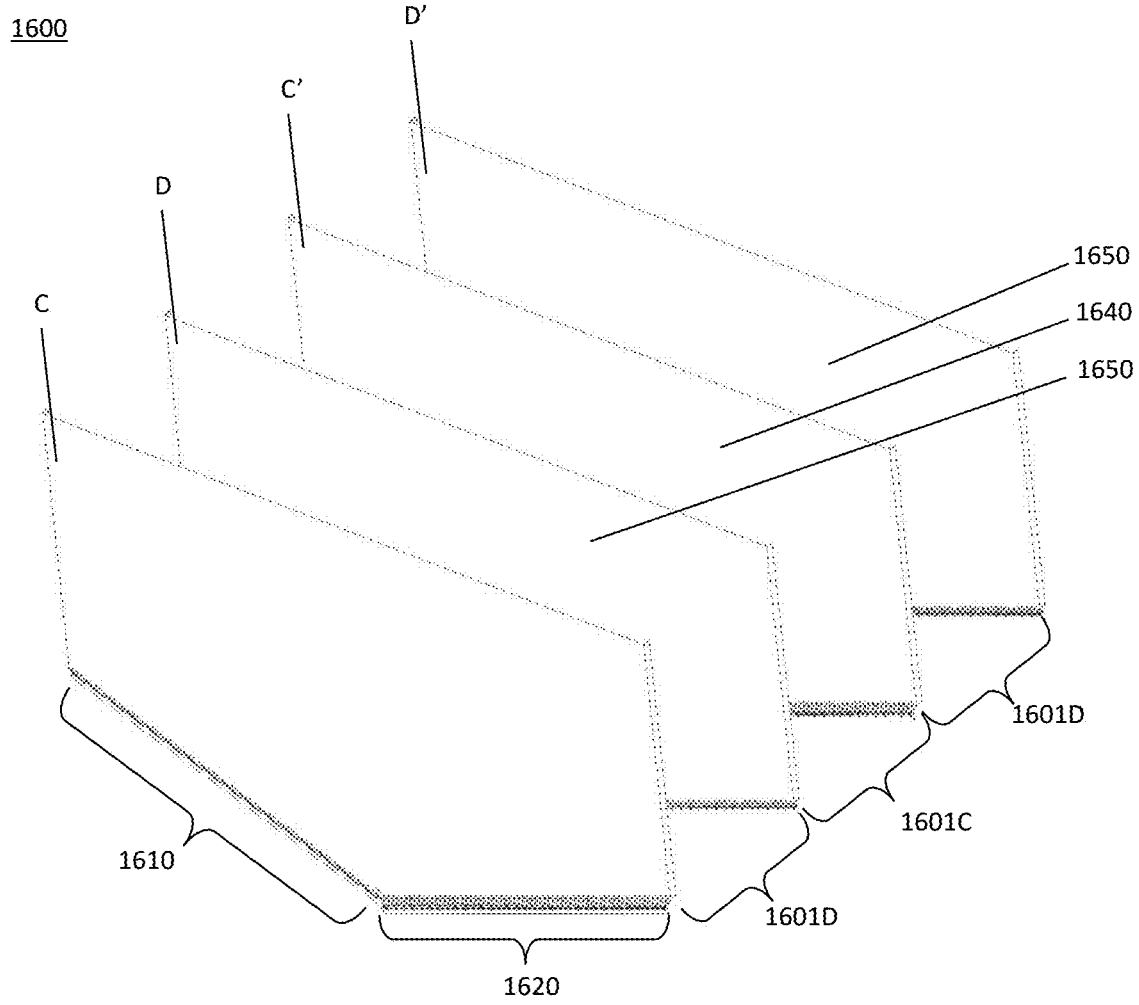
FIG. 4 is an exploded view of the deformed structure of the fog dissipation device in FIG. 3.

FIGS. 3 and 4 show that the fog dissipation device 1601 is formed by stacking a plurality of fog dissipation sheets. The length of the fog dissipation device 1601 may be changed by increasing or decreasing the number of fog dissipation sheets stacked.

Specifically, the fog dissipation device 1601 includes a first flow path 1601C and a second flow path 1601D which are stacked; a first inflow port 1610 for guiding a first air flow flowing from one section of the bottom width of the fog dissipation device 1601 into the first flow path 1601C; a second inflow port 1620 for guiding a second air flow flowing from the other section of the bottom width of the fog dissipation device 1601 into the second flow path 1601D; a first outflow port 1640 through which the first air flow flowing out of the first flow path 1601C is discharged to the upper side of the fog dissipation device 1601; and, a second outflow port 1650 through which the second air flow flowing out of the second flow path 1601D is discharged to the upper side of the fog dissipation device 1601.

In this implementation, the first outflow port 1640 and the second outflow port 1650 that are stacked are formed on the upper side of the fog dissipation device 1601, the first outflow port 1640 and the second outflow port 1650 are arranged alternately, and the thickness of the first and second outflow ports 1640, 1650 are relatively small in the stacking direction of the fog dissipation sheets, so that the first air flow flowing out of the first outflow port 1640 and the second air flow flowing out of the second outflow port 1650 can be mixed quickly and evenly, thereby enhancing the fog dissipation effect. In this embodiment, the first and second flow paths 1601C, 1601D are stacked, and occupy the approximately full width of the fog dissipation device 1601, respectively. Dry cold wind enters the fog dissipation device 1601, absorbs heat and then becomes dry warm wind. Wet hot air enters the fog dissipation device 1601, releases heat and then becomes wet warm air. The wet warm air and the dry warm wind have the same outlet flow direction and the same outlet section size and shape. If the outlet section shape of each channel is wide and thin, the outlet form of the dry warm wind is a wide and thin wind curtain, and the outlet form of the wet warm air is a wide and thin air curtain. It can be known from the jet theory that it is easy to mix the wind curtain and the air curtain having the same flowing direction and the same width, the required mixing distance is small, and the required mixing space is short, so that the tower height can be reduced and the cost can be saved. It is also applicable for the rebuilding of the old tower without increasing height, so that the difficulty of rebuilding the old tower is reduced.

The first inflow port 1610 is communicated with a dry cold wind tunnel B, and the second inflow port 1620 is communicated with a wet hot air tunnel A. Both the first outflow port 1640 and the second outflow port 1650 are communicated with the air mixing portion 1100. In addition, in the fog dissipation device 1600 in this implementation, the width of the first outflow port 1640 is greater than that of the first inflow port 1610, and the flow rate of the first air flow flowing from the first inflow port 1610 is slowed down in the first flow path 1601C; and, the width of the second outflow port 1650 is greater than that of the second inflow port 1620, and the flow rate of the second air flow flowing from the second inflow port 1620 is also slowed down in the second flow path 1601D. Thus, it is advantageous for the heat exchange between the first air flow and the second air flow.

The dry cold wind in the dry cold wind tunnel B enters the first flow path 1601C from the first inflow port 1610 and is then discharged to the air mixing portion 1100 through the first outflow port 1640; and, the wet hot air in the wet hot air tunnel A flows into the second flow path 1601D from the second inflow port 1620, and is then discharged to the air mixing portion 1100 through the second outflow port 1650 and mixed with the dry warm wind discharged from the first outflow port 1640.

In this implementation, a cold wind inflow port 1700 is formed on the lower side of the fog dissipation device 1601, and the cold wind inflow port 1700 is communicated with the first flow path in the fog dissipation device 1600. The cold wind inflow port 1700 runs through at least one sidewall of the cooling tower 1000 in the Y direction to be communicated with external air. Therefore, the dry cold wind outside flows through the dry cold wind tunnel B through the cold wind inflow port 1700 and then enters the first flow path of the fog dissipation device 1601 (as shown by the dotted arrow in FIG. 2).

In addition, the air flowing from the air import portion 1400 successively passes through the heat exchange portion 1300 and the spray portion 1200 from the bottom up to obtain wet hot air, and the wet hot air continuously flows upward through the wet hot air tunnel A to enter the second flow path in the fog dissipation device 1601 (as shown by the solid arrow in FIG. 2).

The dry cold wind in the first flow path 1601C is separated from the wet hot air in the second flow path 1601D by the fog dissipation sheets, and the heat is transferred through the fog dissipation sheets, so that the wet hot air in the second flow path 1601D comes into contact with the cold surface of the first flow path 1601C to form condensed water droplets on the surface of the second flow path 1601D.

As shown in FIG. 3, the fog dissipation device 1601 includes first and second fog dissipation sheets C, D which are stacked alternately and form the first flow path 1601C and the second flow path 1601D, respectively. The first fog dissipation sheet C and the second fog dissipation sheet D are stacked alternately. Two side edges of the first fog dissipation sheet C are bent toward the second fog dissipation sheet D to form first folded edges, and two side edges of the second fog dissipation sheet D are bent toward the first fog dissipation sheet C to form second folded edges. The first folded edges and the second folded edges may form a sealing structure through heat sealing connection. The second flow path 1601D is formed between the first fog dissipation sheet C and the second fog dissipation sheet D, and the first flow path 1601C is formed between the second fog dissipation sheet D and the first fog dissipation sheet C'.

As shown in FIG. 4, the first inflow port 1610 and the second inflow port 1620 on the bottom of the fog dissipation device 1601 may also be arranged in a shape with a downward protruded middle portion, where the first fog dissipation sheet C and the second fog dissipation sheet D are formed as a pentagon, so that the width of the first inflow port 1610 and the second inflow port 1620 can be increased and the section area of the first inflow port 1610 and the second inflow port 1620 are thus increased.

In the functional portion 1630 of the fog dissipation device 1601, a plurality of convex points are formed in middle regions of the first fog dissipation sheet C and the second fog dissipation sheet D, and the convex points play a role in positioning, bonding and supporting between the first fog dissipation sheet C and the second fog dissipation sheet D.

In addition, it is to be noted that, on the basis that the orthographic projection of the fog dissipation device 1601 is rectangular or pentagonal, the fog dissipation devices 1601-1605 may have different heights. If it is necessary to enhance fog dissipation and save water, the height of the fog dissipation devices 1601-1605 may be increased to increase the heat exchange area. If it is necessary to prevent the condensate water from freezing, the height of the fog dissipation devices 1601-1605 may be decreased to prevent the condensate water from freezing due to excessive absorption of cold energy. However, for the rhombic modules in the prior art, the tower has a certain width and there are a certain number of modules, so the width and height of each rhombic module are also fixed. Therefore, the height of the rhombus cannot be separately increased, so that the heat exchange area cannot also be increased. In the fog dissipation device in this implementation, the tower has a certain width, and there are a certain number of fog dissipation devices. Although the width of each fog dissipation device is fixed, the height of each fog dissipation device may be increased or decreased separately, which is not limited by the width and the number of the fog dissipation devices.

Second Implementation

Figure 5:
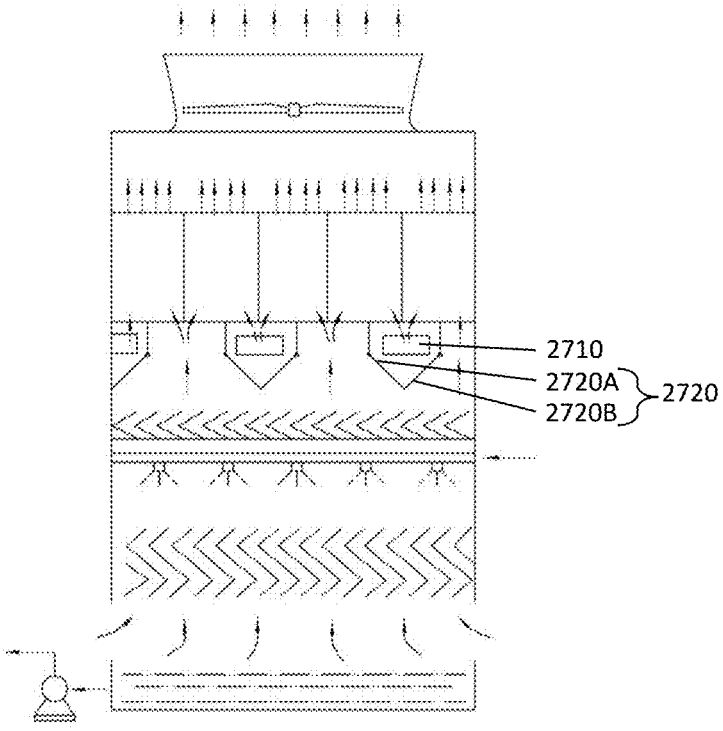
FIG. 5 is a structure diagram of the cold wind inflow port in the cooling tower according to a second implementation, where the cooling tower is in a water-saving fog dissipation mode.

As shown in FIG. 5, in this implementation, further improvements are made on the basis of the cooling tower in the first implementation.

In this implementation, the nozzles in the spray portion 1200 are all opened, so that the heat exchange portion 1300 can have a higher heat exchange area while realizing water-saving fog dissipation.

As shown in FIGS. 5-8, the cold wind inflow port includes a first valve 2710 and a second valve 2720. By adjusting the opening/closing state of the first valve 2710 and the second valve 2720, the operation mode of the cooling tower 200 can be adjusted.

Specifically, the first valve 2710 may be arranged at the inflow port for the dry cold wind of the cold wind inflow port, for example, being mounted on a sidewall of the air chamber of the cooling tower 2000. The cold wind inflow port can be communicated with or separated from external air by the first valve 2710. The air chamber of the cooling tower 200 includes an internal space of the tower from the water collector to the exhaust portion 1020.

The second valve 2720 may be arranged on the bottom of the cold wind inflow port, and the old wind inflow port 2720 is communicated with the internal space of the cooling tower below the cold wind inflow port through the second valve 2720.

As shown in FIG. 5, in winter, the cooling tower starts a water-saving fog dissipation mode, that is, the first valve 2710 is opened and the second valve 2720 is closed. The dry cold wind outside the tower flows into the first flow path of the fog dissipation device from the dry cold wind tunnel B, and the dry cold wind in the first path is separated from the wet hot air in the second flow path by the fog dissipation sheets and performs heat exchange through the fog dissipation sheets, so that the wet hot air in the second path comes into contact with the cold surface of the first flow path to form condensed water droplets on the surface of the second flow path, thereby realizing fog dissipation.

Figure 6:
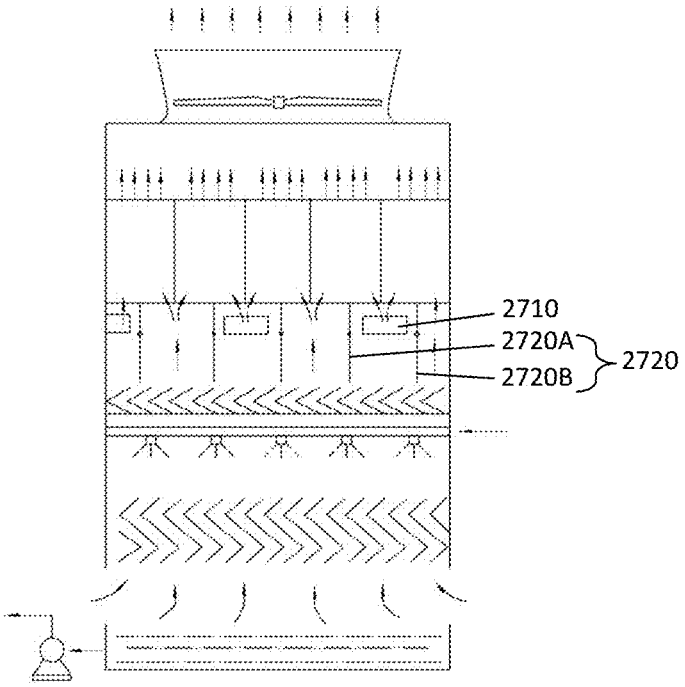
FIG. 6 is a structure diagram of the cold wind inflow port in the cooling tower according to this implementation, where the cooling tower is in a maximum heat dissipation mode.

As shown in FIG. 6, in summer, the cooling tower starts a maximum heat dissipation module, that is, the first valve 2710 is closed and the second valve 2720 is opened. In the maximum heat dissipation mode, both the first flow path and the second flow path of the fog dissipation device are used for circulating the wet hot air, so that the flow resistance of the wet hot air in the fog dissipation portion is reduced and the cooling efficiency of the tower is improved.

The second valve 2720 includes a first valve plate 2720A and a second valve plate 2720B. The fixed end of the first valve plate 2720A is pivoted to one sidewall of the cold wind inflow port, and the fixed end of the second valve plate 2720B is pivoted to the other sidewall of the cold wind inflow port. As shown in FIG. 5, when the second valve 2720 is closed, the free end of the first valve plate 2720A and the free end of the second valve plate 2720B form a sealed connection, and the first valve plate 2720A and the second valve plate 2720B form a sharp corner with a downward tip so as to form a sealed connection. Thus, on one hand, it is advantageous for the wet hot air in the cooling tower 200 to flow upward and be distributed to two sides of the second valve 2720, so that the flow guide effect is achieved and the flow resistance is reduced. On the other hand, in winter, icicle formed in the fog dissipation portion in the cooling tower 2000 falls onto the inclined first valve plate 2720A or second valve plate 2720B, so that the impact force to the valve plate is smaller and the icicle can be prevented from damaging or even puncturing the valve plate.

Figure 7:
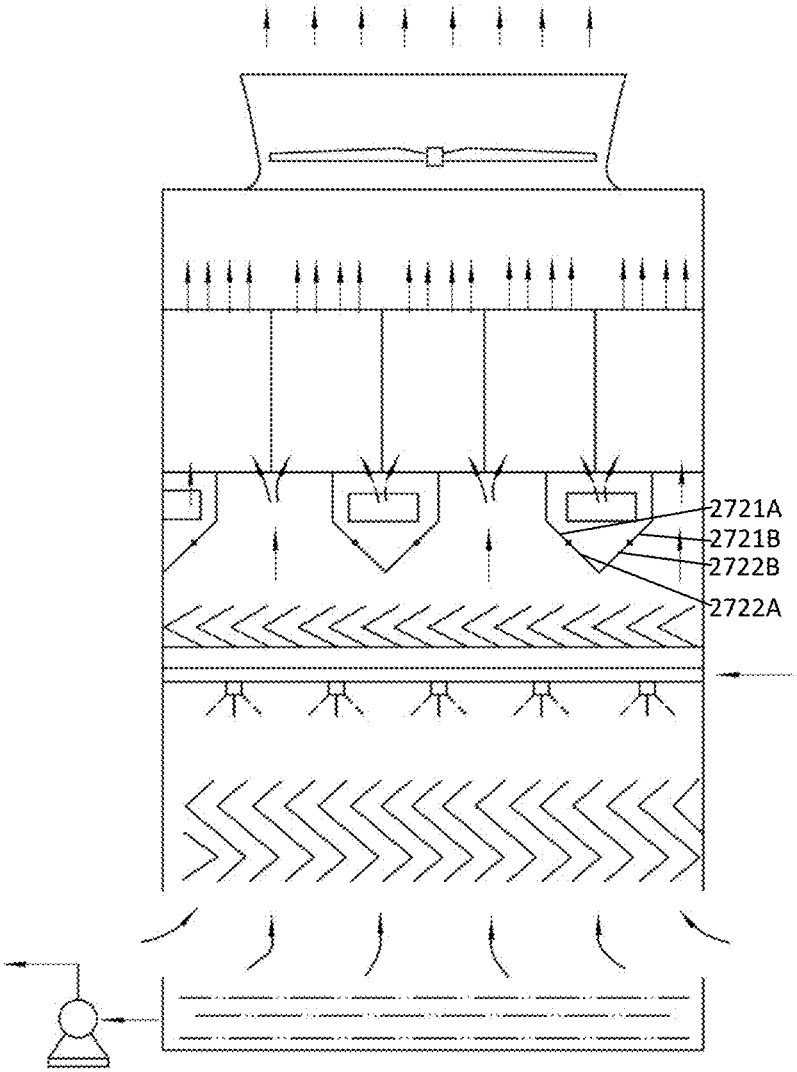
FIG. 7 is a schematic diagram of the deformed structure of the second valve in the cooling tower in FIG. 5.
Figure 8:
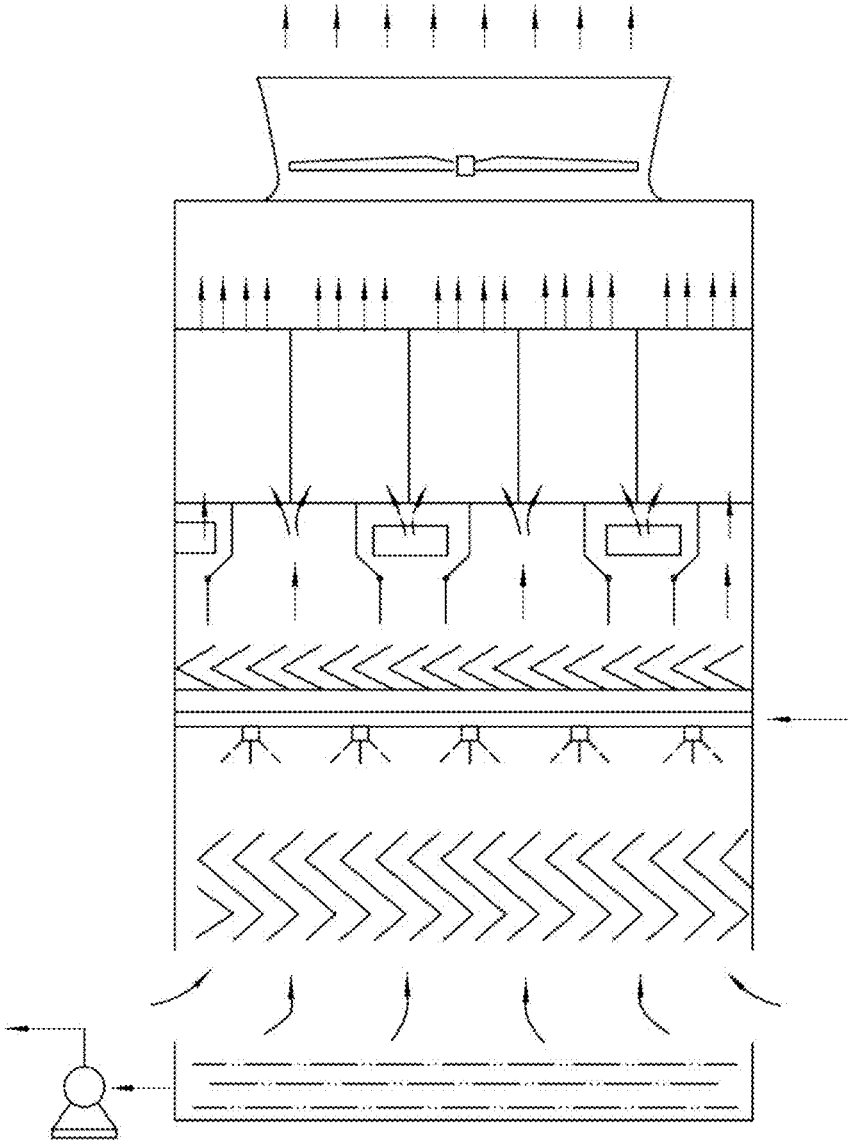
FIG. 8 is a schematic diagram of the deformed structure of the second valve in the cooling tower in FIG. 6.

In addition, as shown in FIGS. 7 and 8, the first valve plate 2720A and the second valve plate 2720B may adopt the following structure. The first valve plate 2720A includes a first portion 2721A and a second portion 2722A, and the second valve plate 2720B includes a third portion 2721B and a fourth portion 2722B. The first end of the first portion 2721A is fixedly connected to one sidewall of the cold wind inflow port, while the second end thereof is pivoted to the first end of the second portion 2722A. The first end of the third portion 2721B is fixedly connected to the other sidewall of the cold wind inflow port 2700, while the second end thereof is pivoted to the first end of the fourth portion 2722B. When the second valve 2720 is closed, the second end of the second portion 2721A and the second end of the fourth portion 2722B form a sealed connection, and the firth valve plate 2720A and the second valve plate 2720B form a sharp corner with a downward tip, so that it is convenient for the opening or closing the second valve 2720.

Third Implementation

In this implementation, further improvements are made to the fog dissipation sheets of a rectangular structure in the first implementation, wherein the thickness of the first inflow port 1610 and the second inflow port 1620 in the stacking direction of the fog dissipation sheets is increased, so that the thickness of the first inflow port 1610 and the second inflow port 1620 is increased, and the flow resistance is reduced.

Figure 9:
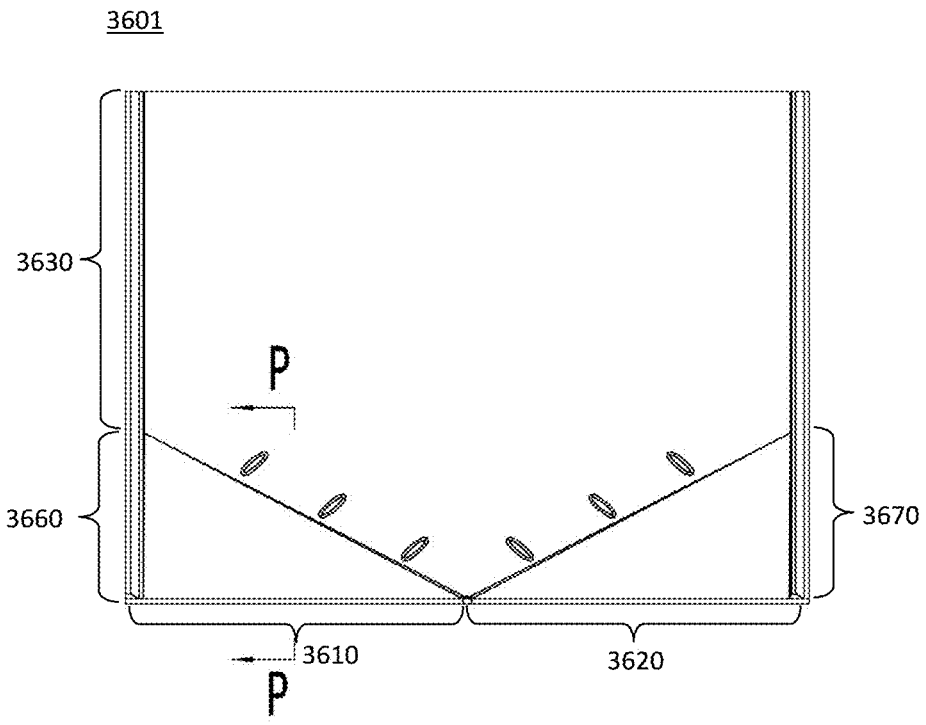
FIG. 9 is a front view of the fog dissipation device according to a third implementation.
Figure 10:
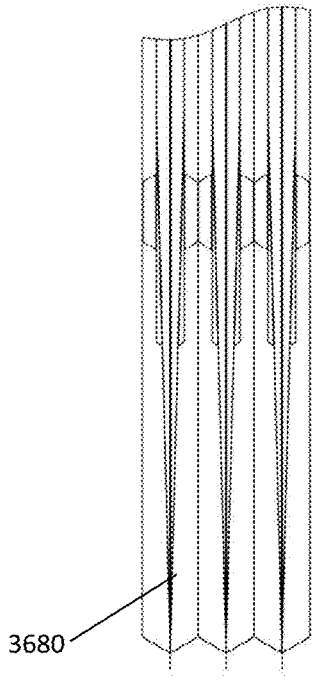
FIG. 10 is a sectional view of FIG. 9 taken along P-P.

As shown in FIG. 9, in the fog dissipation device 3601, a downward sharp corner is formed in the lower portion of the functional portion 3630, a first import portion 3660 is formed on the left side of the sharp corner, and a second import portion 3670 is formed on the right side of the sharp corner. A first inflow port 3610 is formed at the lower end of the first import portion 3660, and a second inflow port 3620 is formed at the lower end of the second import portion 3670. By providing the first import portion 3660 and the second import portion 3670, the bottom of the fog dissipation device 3601 is formed as a flat shape. Compared with the sharp corner structure, it is greatly convenient for mounting and disassembly, and the fog dissipation device can be mounted without any support frame, so that the manufacturing and mounting cost is reduced, and the problem that it is difficult to disassemble the support frame after corrosion is avoided.

In addition, as shown in FIGS. 9-12, by forming flared structures 3680 in the first import portion 3660 and the second import portion 3670, the thickness of the first inflow port 3610 and the second inflow port 3620 is increased, and the flow resistance is reduced. The thickness of the first and second inflow ports 3610 and 3620 is increased to 2T, and the thickness of the first flow path 3601C and the second flow path 3601D is T.

Figure 11:
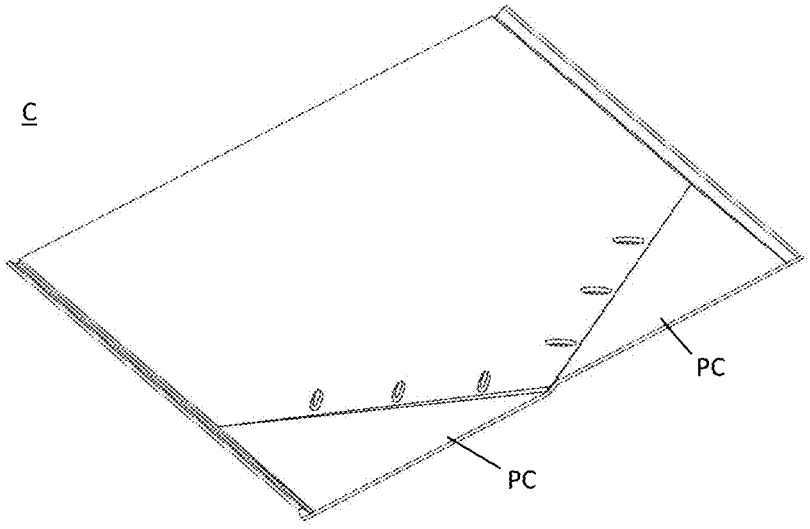
FIG. 11 is a structure diagram of the first fog dissipation sheet in the fog dissipation device according to this implementation.
Figure 12:
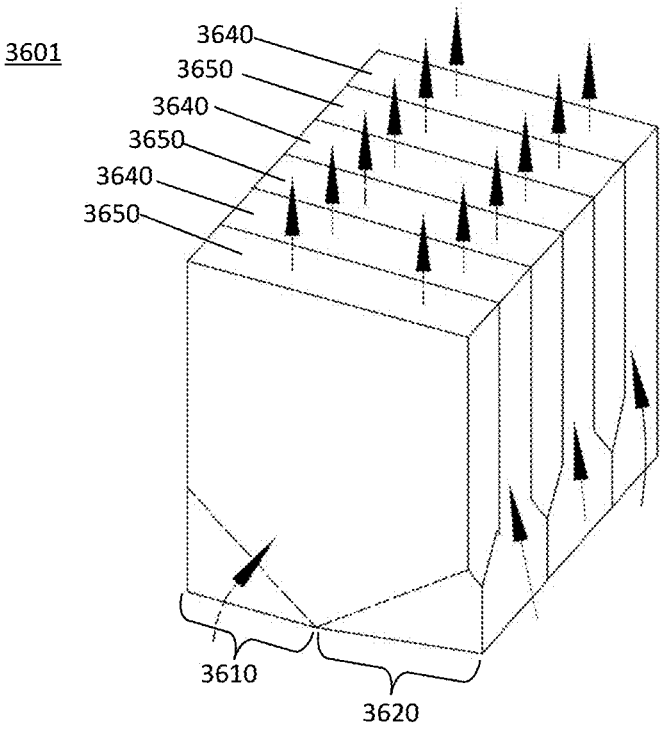
FIG. 12 is a stereoscopic view of a portion of the fog dissipation device according to this implementation.
Figure 13:
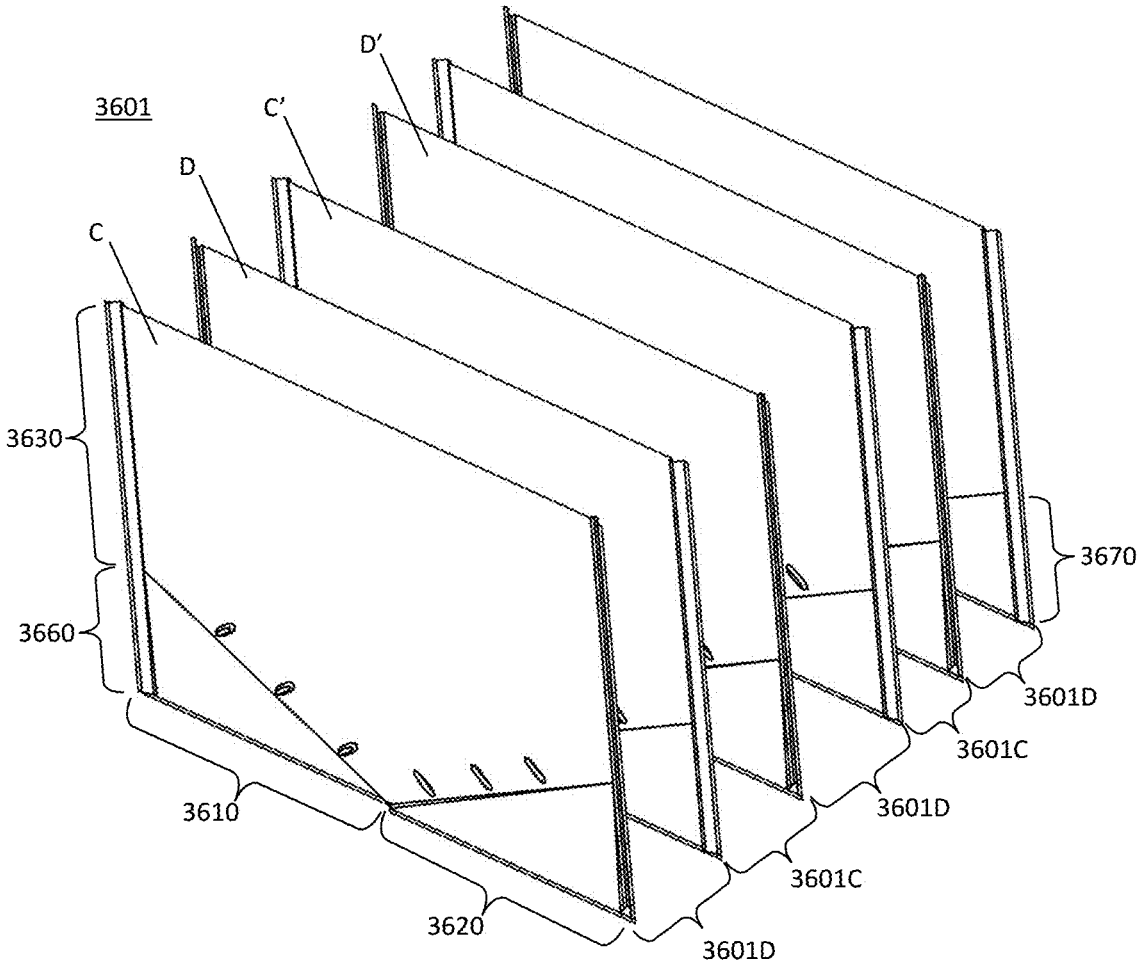
FIG. 13 is an exploded view of a portion of the fog dissipation device according to this implementation.

As shown in FIGS. 11 and 12, the formation of the flared structure 3680 will be described by taking the first fog dissipation sheet C as an example. The left side of the first fog dissipation sheet C at the width center is deflected to the inner side of the paper to form a deflected portion PC, and the right side of the first fog dissipation sheet C at the width center is deflected to the outer side of the paper to form a deflected portion PC. However, the deflection direction of the deflected portion PD in the lower portion of the second fog dissipation sheet D is opposite to that of the deflected portion PC of the first fog dissipation sheet C. Thus, as shown in FIGS. 9 and 13, a second flow path 3601D and a second import portion 3670 communicated with the second flow path 3601D are formed between the first fog dissipation sheet C and the second fog dissipation sheet D. The second import portion 3670 is formed on the right side of the fog dissipation device 3601 in its width direction. Similarly, a first flow path 3601C and a first import portion 3660 communicated with the first flow path 3601C are formed between the second fog dissipation sheet D and the first fog dissipation sheet C'. The first import portion 3660 is formed on the left side of the fog dissipation device 3601 in its width direction.

It is to be noted that, the thickness of the first inflow port 3610 and the second inflow port 3620 may also be adjusted as required. For example, by changing the deflection amount of the deflected portion PC and the deflected portion PD, the thickness of the first import portion 3660 and the second import portion 3670 is adjusted.

Fourth Implementation

In FIG. 9, the width of the bottom edge of the first import portion 3660 (i.e., the width of the first inflow port 3610) is the same as the width of the bottom edge of the second import portion 3670 (i.e., the width of the second inflow port 3620).

In winter, the cooling tower starts a water-saving fog dissipation mode, and the amount of the dry cold wind required by fog dissipation is properly adjusted according to the external ambient temperature.

Figure 14:
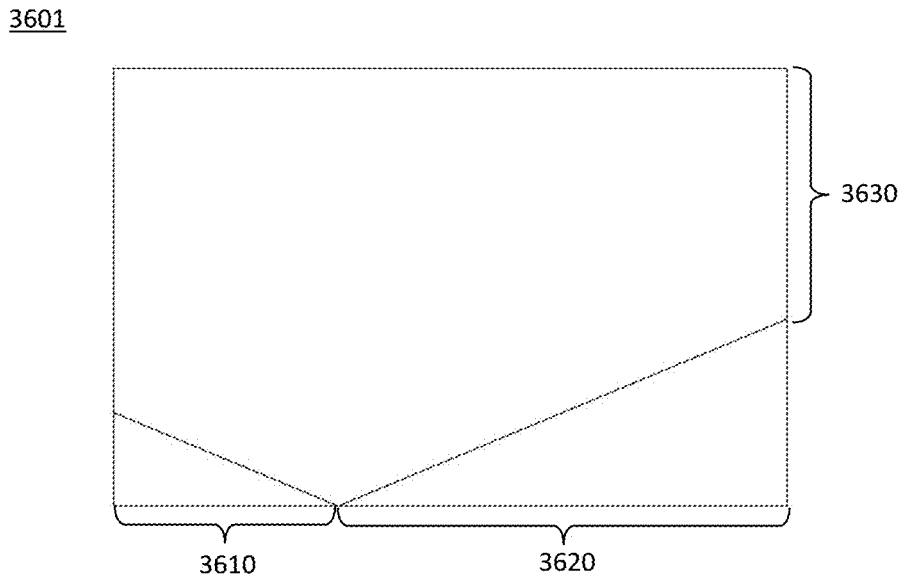
FIG. 14 is a front view of one layout of the fog dissipation device according to a fourth implementation.

As shown in FIG. 14, in this implementation, the proportion of the width of the first inflow port 3610 and the second inflow port 3620 may be a different value according to the amount of the required dry cold wind. Specifically, for example, the dry cold wind is fed into the first inflow port 3610, and the wet hot air is fed into the second inflow port 3620. The width of the first inflow port 3610 and the width of the fog dissipation device 3601 generally satisfy the following rule:

$$x=k\,l$$

where x is the width of the first inflow port 3610;

l is the width of the fog dissipation device 3601; and k is a coefficient, and $0<k<1$. Correspondingly, the lower the ambient temperature is, the larger the k is.

Thus, the cooling tower starts the water-saving dog dissipation mode in winter, and the width of the first inflow port 3610 is set according to the external ambient temperature. For example, when the ambient temperature is lower, the width of the first inflow port 3610 is set to be greater than that of the second inflow port 3620, so that the dry cold wind inlet becomes wider, and the wind inlet amount is larger, thereby enhancing the fog dissipation capability.

In addition, as shown in FIG. 14, when the width of the first inflow port 3610 is set to be less than that of the second inflow port 3620, the apex of the sharp corner in the lower portion of the functional portion 3630 is moved leftward, thus causing the left bevel edge of the sharp corner to be shorter than the right bevel edge. As a result, the wind inlet area of the first inflow port 3610 is reduced, the flow dead zone of the air flow on the right side of the lower portion of the functional portion 3630 is enlarged, and the efficiency of heat exchange between the first air flow in the first flow path 3601C and the second air flow in the second flow path 3601D is reduced.

Figure 15:
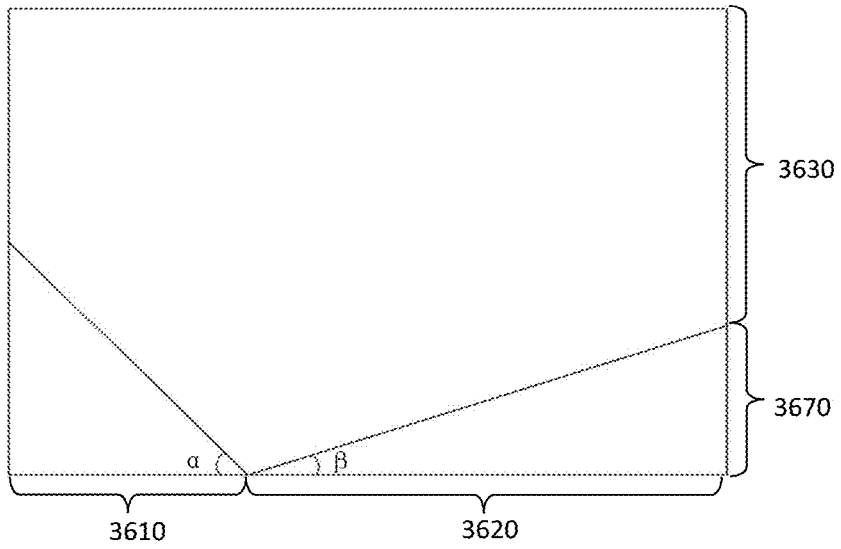
FIG. 15 is a front view of another layout of the fog dissipation device according to this implementation.

To solve the above technical problems, as shown in FIG. 15, in the fog dissipation device 3601 in this implementation, the included angle between the left bevel edge of the sharp corner in the lower portion of the functional portion 3630 (i.e., the outflow side of the first import portion 3660) and the horizontal plane is greater than the included angle between the right bevel edge (i.e., the outflow side of the second import portion 3670) and the horizontal plane, and the left bevel edge is rotated upward for extension about the apex of the sharp corner, so that the dimension of the left bevel edge is increased, the wind inlet area of the air flow is increased, and the overflowing resistance is reduced. Thus, the air flow can smoothly reach the full width range of the functional portion 3630, and the heat exchange efficiency of the fog dissipation device 3601 is improved. Similarly, if the wet hot air is fed into the first inflow port 3610 and the dry cold wind is fed into the second inflow port 3620, the width of the first inflow port 3610 is greater than that of the second inflow port 3620, and the included angle between the left bevel edge of the sharp corner in the lower portion of the functional portion 3630 (i.e., the bevel edge of the first import portion 3660 on the outflow side) and the horizontal plane is less than the included angle between the right bevel edge (i.e., the bevel edge of the second import portion 3670 on the outflow side) and the horizontal plane.

Fifth Implementation

In this implementation, further improvements are made on the basis of the third implementation, wherein the transition structures of the air flows the first and second flow paths 3601C, 3601D through the first import portion 3660 and the second import portion 3670 are changed, so that the flow resistance at transition is reduced.

Figure 22:
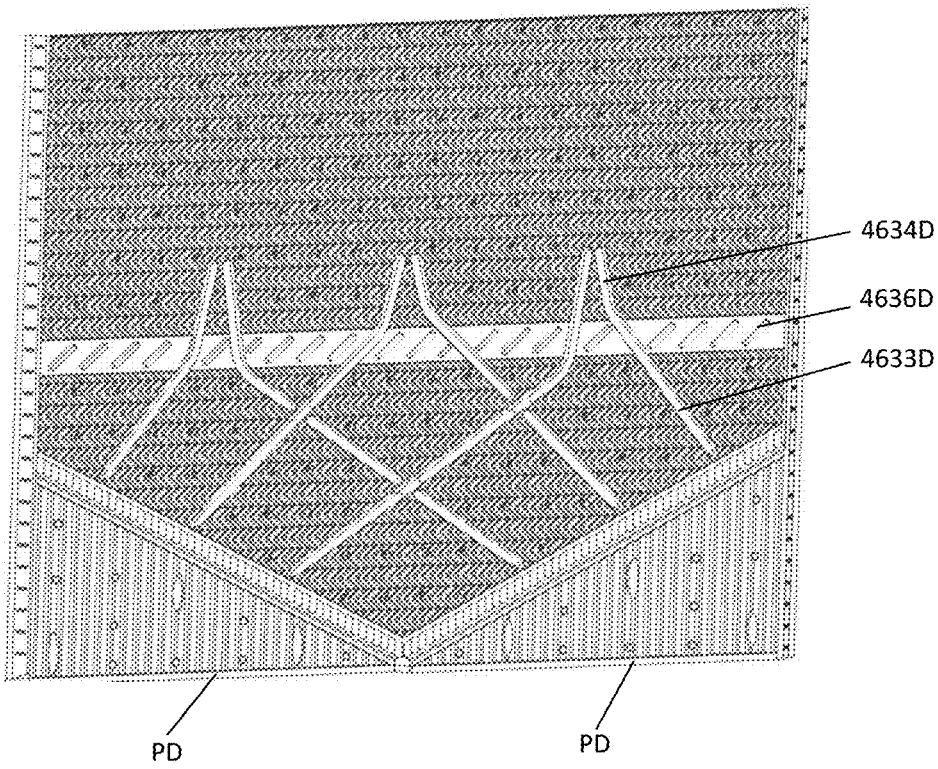
FIG. 22 is a stereoscopic view of the second fog dissipation sheet in the fog dissipation device according to this implementation.

As shown in FIGS. 11, 13 and 22, in the fog dissipation device 3601, the description is given by taking the first fog dissipation sheet C as an example. The left side of the first fog dissipation sheet C at the width center is deflected to the inner side of the paper to form a deflected portion PC, and the right side of the first fog dissipation sheet C at the width center is deflected to the outer side of the paper to form a deflected portion PC. However, the deflection direction of the deflected portion PD in the lower portion of the second fog dissipation sheet D is opposite to that of the deflected portion PC of the first fog dissipation sheet C. The left defected portion PC of the first fog dissipation sheet C and the left defected portion PD of the second fog dissipation sheet D on one side of the stacking direction form a sealed connection portion by bonding or in other ways, and the right deflected portion PC of the first fog dissipation sheet C and the right deflected portion PD of the second fog dissipation sheet D on one side of the stacking direction form a second import portion 3670. The deflected portion PD of the second fog dissipation sheet D and the right deflected portion PC of the first fog dissipation sheet C' on one side of the stacking direction form a sealed connection portion by bonding or in other ways, and the left deflected portion PD of the second fog dissipation sheet D and the left deflected portion PC of the first fog dissipation sheet C' on one side of the stacking direction form a first import portion 3660. Thus, in the first import portion 3660, the thickness of the first inflow port 3610 is greater than that of the first flow path 3601C so that a flared structure 3680 is formed; and, in the second import portion 3670, the thickness of the second inflow port 3620 is greater than that of the second flow path 3601D so that a flared structure 3680 is formed. A first transition portion 3681 is formed between the first flow path 3601C and the first import portion 3660, a second transition portion is formed between the second flow path 3601D and the second import portion 3670, and the air flows at the flared structures 3680 of the first and second import portions 3660, 3670 are transited to the first and second flow paths 3601C, 3601D. The first transition portion 3681 and the second transition portion are of the same structure.

Figure 16:
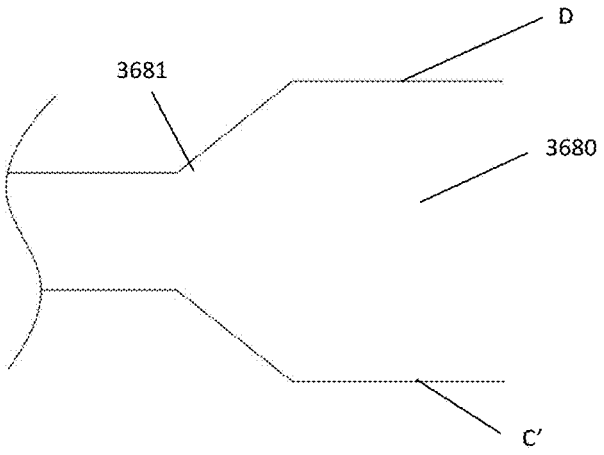
FIG. 16 is a structure diagram of the first transition portion in the fog dissipation device according to the third implementation.
Figure 17:
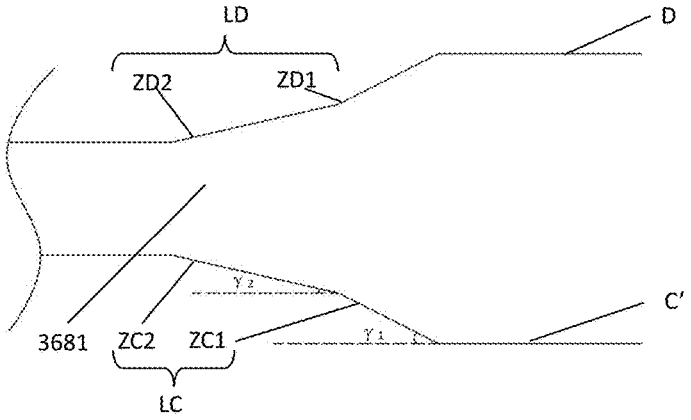
FIG. 17 is a structure diagram of the first transition portion in the fog dissipation device according to a fifth implementation.

FIG. 16 is a structure diagram of the first transition portion 3681 in this implementation, and FIG. 17 is a structure diagram of the first transition portion 3681 in this implementation.

As shown in FIG. 16, the first transition portion 3681 in the third implementation is directly formed in the deflection process of the deflected portion PC and the deflected portion PD. The downflow section of the first transition portion 3681 is generally trapezoidal with a thick inlet and a thin outlet, and the overflowing resistance is relatively high.

As shown in FIG. 17, in the first transition portion 3681 in this implementation, the thickness of the air flow gradually decreases, and the overflowing resistance can be properly reduced.

The following description will be given by taking the first transition portion 3681 formed between the first fog dissipation device C' and the second fog dissipation device D.

As shown in FIG. 17, the deflected portion PC of the first fog dissipation sheet C' forms a first connection portion LC during the deflection process, the deflected portion PD of the second fog dissipation sheet D forms a first connection portion LD during the deflection process, and the first transition portion 3681 is formed between the first connection portion LC and the first connection portion LD. The first connection portion LC on the first fog dissipation sheet C' is formed to bend a substrate at least one time to form a concave-convex shape, and the first connection portion LD on the second fog dissipation sheet D is formed to bent the substrate at least one time in a direction opposite to the first connection portion LC on the first fog dissipation sheet C' to form a concave-convex shape.

By taking the first connection portion LC bending the substrate one time to form a concave-convex shape as an example, in this implementation, as shown in FIG. 17, the first connection portion LC is bent from one point (i.e., bending point) thereon to one side of the first connection portion LD, a first bending portion ZC1 is formed between the bending point and the end of the first connection portion LC close to the import portion, and a second bending portion ZC2 is formed between the bending point and the end of the first connection portion LC close to the flow path. The first connection portion LC is divided into the first bending portion ZC1 and the second bending portion ZC2. The included angle $_1$ between the first bending portion ZC1 and the horizontal plane is greater than that included angle $_2$ between the second bending portion ZC2 and the horizontal plane, so that the slope of the second bending portion ZC2 is reduced, the difficulty in air flow passage is reduced, and the overflowing resistance is decreased. Correspondingly, the first connection portion LD is bent from one point (bending point) thereon to one side of the first connection portion LC, a first bending portion ZD1 is formed between the bending point and the end of the first connection portion LD close to the import portion, and a second bending portion ZD2 is formed between the bending point and the end of the first connection portion LD close to the flow path. In the stacking direction of the fog dissipation device, the thickness between the bending point on the first connection portion LC and the bending point on the first connection portion LD should be greater than the thickness of the flow path in the stacking direction and less than the thickness of the inflow port in the stacking direction. The first connection portion LD is divided into the first bending portion ZD1 and the second bending portion ZD2. In cooperation with the first connection portion LC, the flow resistance of the air flow when passing through the first transition portion 3681 is reduced. The first connection portion LC mat also be bent away from the first connection portion LD or alternately bent in directions, as long as the thickness of the bending point on the first connection portion LC and the bending point on the first connection portion LD in the stacking direction is greater than the thickness of the flow path in the stacking direction and less than the thickness o the inflow port in the stacking direction.

It is to be noted that the length of the first bending portions ZC1, ZD1 and the second bending portions ZC2, ZD2 may be adjusted as required. For example, when the first connection portion LC is bent to the first connection portion LD, the length of the first bending portions ZC1, ZD1 is less than that of the corresponding second bending portions ZC2, ZD2, the air flow enters the flow path more smoothly from the import portion through the first transition portion 3681, thereby reducing the flow resistance.

Similarly, when the first connection portion LC is bent for n (n>1) times, n bending points are formed on the first connection portion LC to divide the first connection portion LC into n+1 portions, and the slope of the n+1 portions gradually decreases from the upstream to downstream of the air flow. Correspondingly, n bending points are formed on the first connection portion LD to divide the first connection portion LD into n+1 portions, the bending direction of the n+1 portions is opposite to that of the first connection portion LC, and the slope of the n+1 portions gradually decreases from the upstream to downstream of the air flow. In cooperation with the first connection portion LC, the effect of reducing flow resistance is achieved. The thickness between each bending point on the first connection portion LC and the corresponding bending point on the first connection portion LD in the stacking direction should be greater than the thickness of the flow path in the stacking direction and less than the thickness of the inflow port in the stacking direction.

In addition, the increase of the bent parts will lengthen the transition distance and in turn lengthen the inlet bevel edge of the functional portion, so that the flow resistance of the transition portion is reduced as far as possible. However, the number of times of bending the first connection portions LC, LD should not be too large, thereby avoiding the reduction of the heat exchange area of the fog dissipation device due to too long inlet bevel edge.

Sixth Implementation

Figure 18:
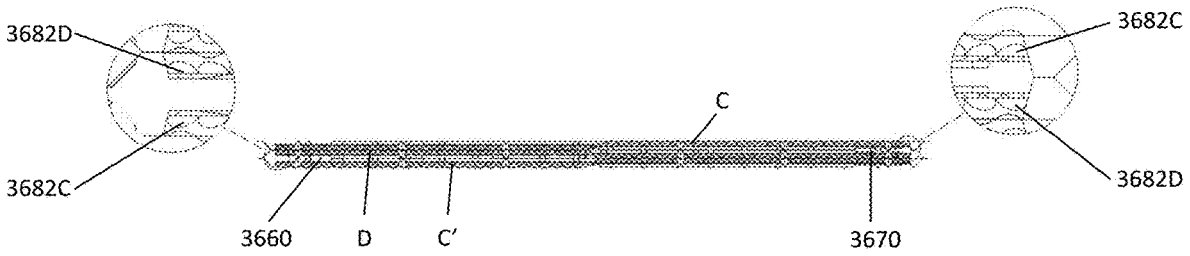
FIG. 18 is a side view of a portion of the fog dissipation device according to a sixth implementation.

FIG. 18 is a structure diagram after the first fog dissipation sheet C, the second fog dissipation sheet D and the first fog dissipation sheet C' are stacked and a partially enlarged view thereof.

In FIG. 18, at the first transition portion 3681, a plurality of downflow grooves 3682C are formed on the first connection portion LC on the left side of the first fog dissipation sheet C', and a plurality of grooves 3682D are formed on the first connection portion LD on the left side of the second fog dissipation sheet D stacked with the first fog dissipation sheet C'. At the second transition portion formed by the deflected portion PC on the right side of the first fog dissipation sheet C and the deflected portion PD on the right side of the second fog dissipation sheet D, a plurality of grooves 3682C are formed on the first connection portion LC on the right side of the first fog dissipation sheet C, and a plurality of grooves 3682D are formed on the first connection portion LD on the right side of the second fog dissipation sheet D stacked with the first fog dissipation sheet C. Due to the arrangement of the grooves 3682C and the grooves 3682D, on one hand, the mechanical strength at the first transition portion 3681 and the second transition portion is enhanced; on the other hand, the wind inlet area of the air flow is increased, and it is advantageous to reduce the flow resistance when the air flow enters the corresponding flow path from the import portion.

Seventh Implementation

In the fog dissipation device 3601 in the third implementation, the air flow easily flows in regions between the first inflow port 3610 and the first outflow port 3640 and between the second inflow port 3620 and the second outflow port 3650, but there is a few air flow at the lower corner of the functional portion 3630. As a result, the efficiency of heat exchange between the first air flow in the first flow path 3601C and the second air flow in the second flow path 3601D is relatively reduced.

To solve the above technical problems, as shown in FIGS. 19-22, in this implementation, a first flow guide structure for guiding the first air flow into an approximately full width range of the fog dissipation device is formed on the fog dissipation device 4601, the fog dissipation device 4601 is divided into a plurality of independent first flow guide chambers by the first flow guide structure, and the plurality of first flow guide chambers occupy the approximately full width of the fog dissipation device 4601. A second flow guide structure for guiding the second air flow into the approximately full width range of the fog dissipation device 4601 is formed in the fog dissipation device, the fog dissipation device 4601 is divided into a plurality of independent second flow guide chambers by the second flow guide structure, and the plurality of second flow guide chambers occupy the approximately full width of the fog dissipation device 4601.

Figure 19:
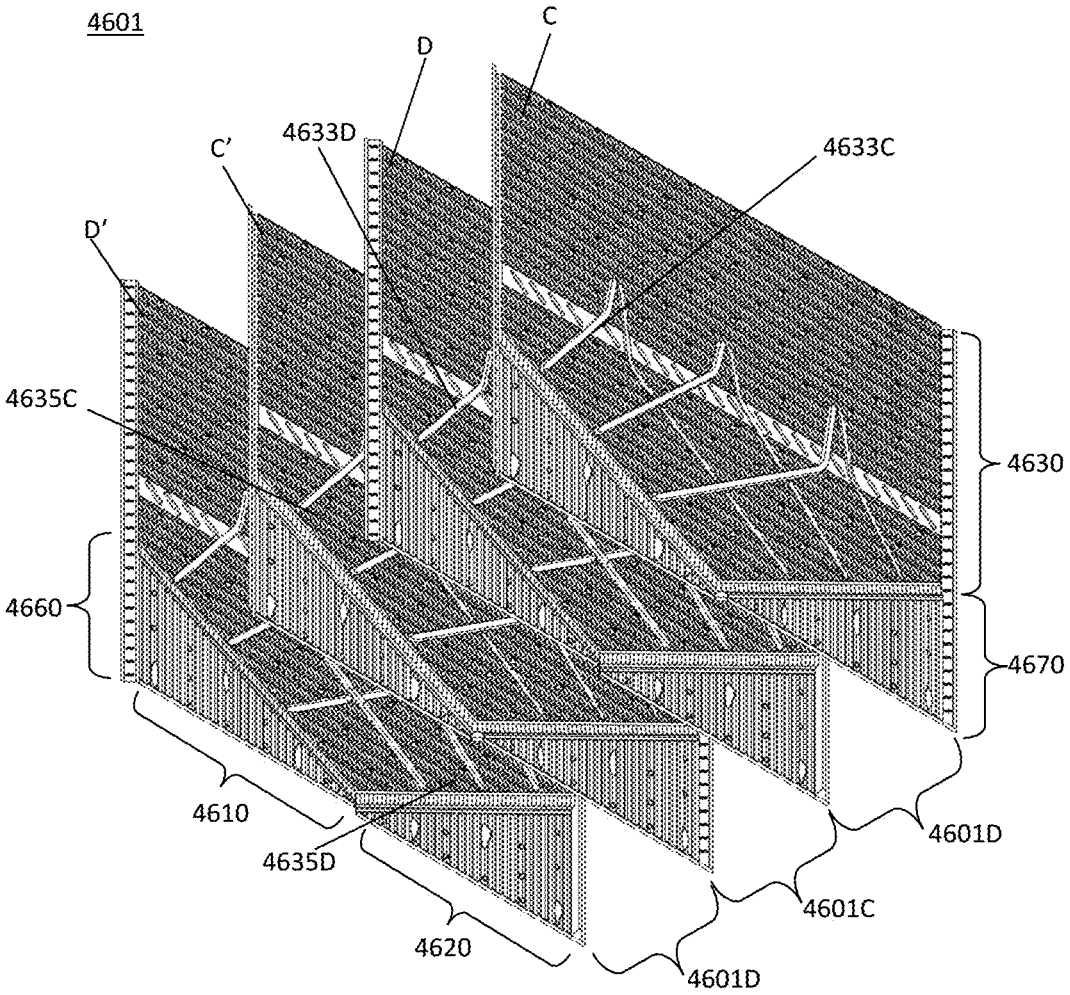
FIG. 19 is an exploded view of a portion of the fog dissipation device according to a seventh implementation.

The composition structure of the first and second flow guide structures will be described below. As shown in FIG. 19, a plurality of first flow guide ribs protruded to one side and a plurality of second flow guide ribs protruded to the other side are formed on the surface of the first fog dissipation sheet C. Third flow guide ribs that are protruded to one side and correspond to the second flow guide ribs and fourth flow guide ribs that are protruded to the other side and correspond to the first flow guide ribs are formed on the surface of the second fog dissipation sheet D. The second flow guide ribs correspond to the third flow guide ribs, and the tips of the both are sealed with and resisted against each other. Preferably, the tips of the second flow guide ribs and the third flow guide ribs may be bonded to form the first flow guide structure, so that a plurality of independent first flow guide chambers are formed. The first flow guide ribs correspond to the fourth flow guide ribs, and the tips of the both are sealed with and resisted against each other. Preferably, the tips of the first flow guide ribs and the fourth flow guide ribs may be bonded to form the second flow guide structure, so that a plurality of independent second flow guide chambers are formed.

Figure 20:
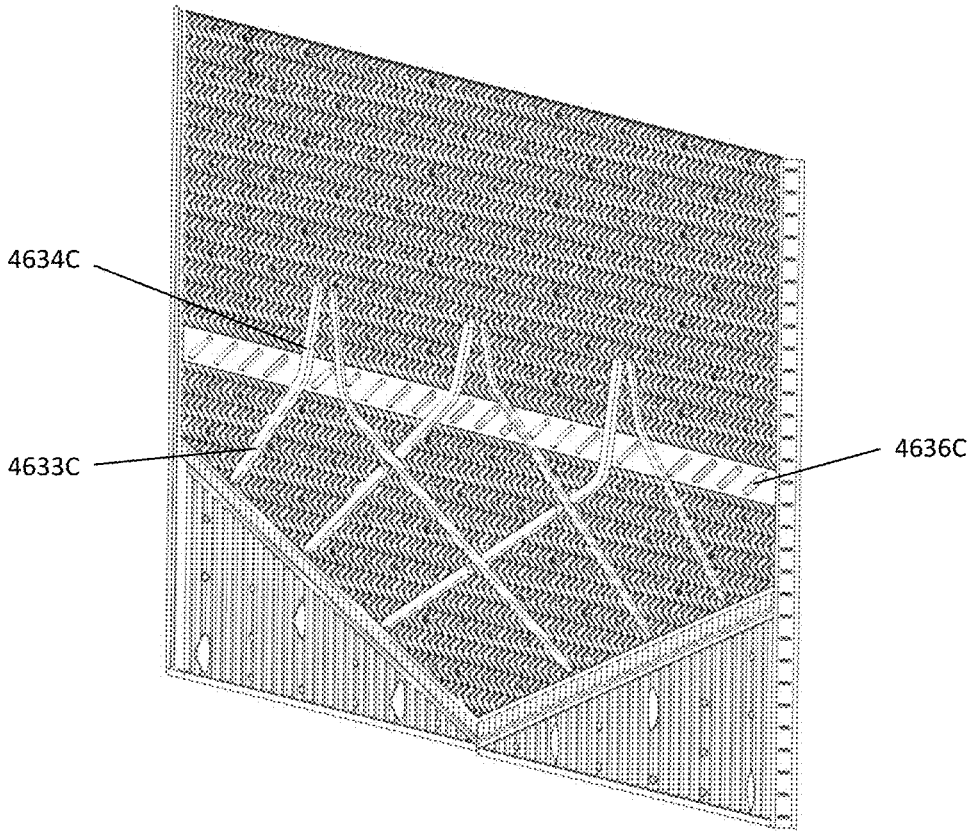
FIG. 20 is a stereoscopic view of the first fog dissipation sheet in the fog dissipation device according to an eighth implementation.
Figure 21:
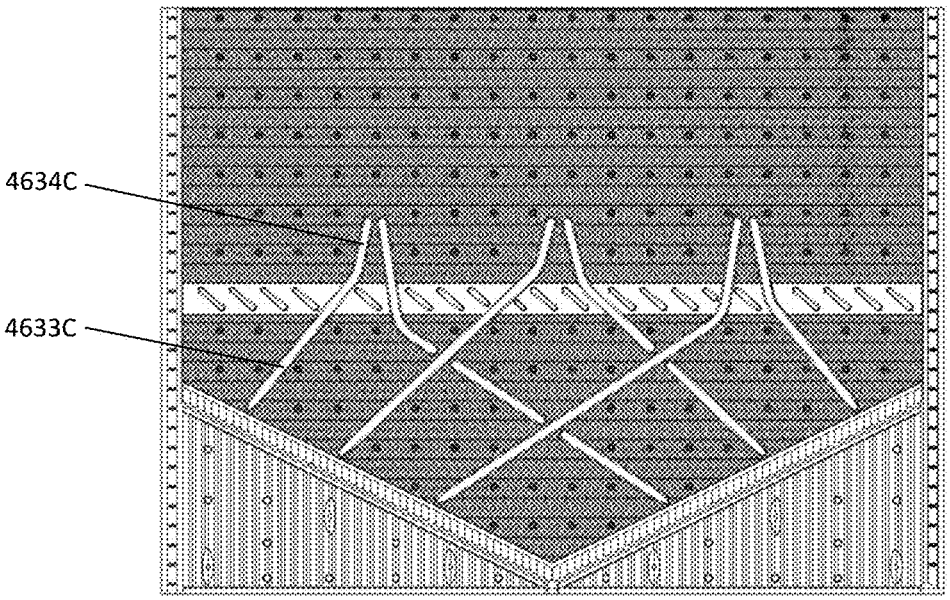
FIG. 21 is a rear view of the first fog dissipation sheet in the fog dissipation device according to this implementation.

Specifically, as shown in FIG. 20, the first flow guide ribs are protruded to the outer side of the paper, and the plurality of first flow guide ribs may be first extension sections 4633C extending obliquely upward, wherein the first ends of the first extension sections 4633C extend to the left bevel edge of the lower sharp corner of the functional portion, while the second ends thereof extend obliquely to the upper right. When viewed from the rear side of the first fog dissipation sheet C, as shown in FIG. 21, the second flow guide ribs may be first extension sections 4633C extending obliquely upward. The first ends of the first extension sections 4633C extend to the left bevel edges of the lower sharp corner of the functional portion 4630, while the second ends thereof extend obliquely to the upper right.

Similarly, as shown in FIG. 22, the third flow guide ribs may be first extension sections 4633D that extend obliquely upward and correspond to the first extension sections 4633C of the second flow guide ribs, and the fourth flow guide ribs may be first extension sections 4633C corresponding to the first extension sections 4633C of the first flow guide ribs. The first extension sections 4633C in the first flow guide ribs correspond to the first extension sections 4633D in the fourth flow guide ribs, and the tips of the both are sealed with and resisted against each other. Preferably, the tips of the first extension sections 4633C and the first extension sections 4633D are bonded to form the first flow guide structure, so that a plurality of independent first flow guide chambers are formed. The first extension sections 4633C in the second flow guide ribs correspond to the first extension sections 4633D in the third flow guide ribs, and the tips of the both are sealed with and resisted against each other. Preferably, the tips of the first extension sections 4633C and the first extension sections 4633D are bonded to form the second flow guide structure, so that a plurality of independent second flow guide chambers are formed.

As shown in FIGS. 20-22, the upper ends (i.e., second ends) of the first extension sections 4633C of the first and second flow guide ribs are connected with second extension sections 4634C bent upward, and the second extension sections 4634C and the first extension sections 4633C have the same protruding direction. The plurality of second extension sections 4633C extend obliquely upward from the junctions with the first extension sections 4633C to evenly divide the approximately full width of the functional portion 4630, so that the incoming air flow is guided to the approximately full width range of the fog dissipation device 460 and then flows out from the outflow port after heat exchange. The junctions of the first extension sections 4633C with the second extension sections 4634C may be, but not limited to, arc-shaped, so that the resistance of air flow passage is reduced. The first extension sections 4633C and the second extension sections 4634C may also be integrally formed as being arc-shaped. Similarly, second extension sections 4634D corresponding to the second extension sections 4633C are arranged on the third flow guide ribs and the fourth flow guide ribs, the second extension sections 4634C in the first flow guide ribs correspond to the second extension sections 4634D in the fourth flow guide ribs, and the tips of the both are sealed with and resisted against each other. Preferably, the tips of the second extension sections 4634C and the second extension sections 4634D may be bonded; and, the second extension sections 4634C in the second flow guide ribs correspond to the second extension sections 4634D in the third flow guide ribs, and the tips of the both are sealed with and resisted against each other. Preferably, the tips of the second extension sections 4634C and the second extension sections 4634D may be bonded.

In addition, the upper ends of the second extension portions 4634C, 4634D are lower than the outflow port, so that it is convenient for the wet hot air and the dry cold wind to freely flow in the functional portion; and, the upper ends of the second extension portions 4634C, 4634D may also extend upward to the outflow port.

The rib spacing of the first flow guide chambers gradually increases from the upstream to downstream of the air flow until the upper end of the first flow guide structure evenly divides the approximately full width of the functional portion 4630. The rib spacing of the second flow guide chambers gradually increases from the upstream to downstream of the air flow until the upper end of the second flow guide structure evenly divides the approximately full width of the functional portion 4630.

Figure 23:
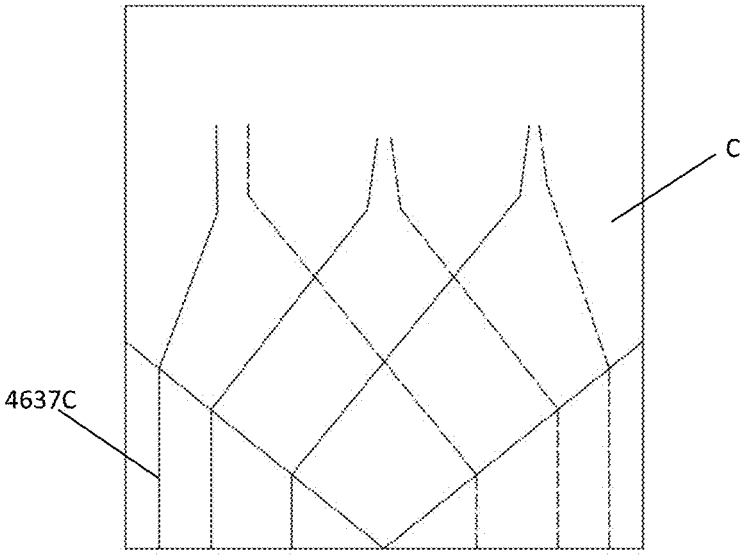
FIG. 23 is another layout of the first flow guide ribs and the second flow guide ribs in the fog dissipation device according to this implementation.
Figure 24:
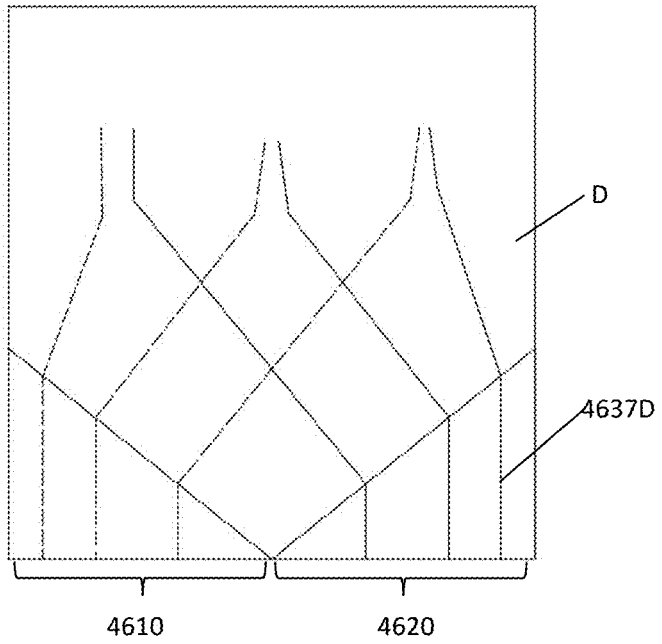
FIG. 24 is another layout of the third flow guide ribs and the fourth flow guide ribs in the fog dissipation device according to this implementation.
Figure 25:
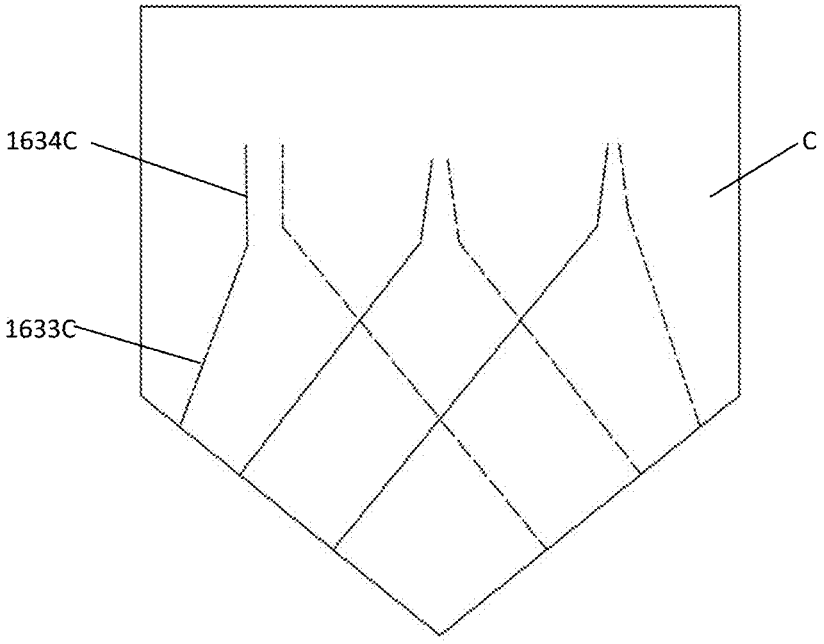
FIG. 25 is a front view of the first fog dissipation sheet in the fog dissipation device of one structure according to a ninth implementation.

In addition, as shown in FIGS. 23 and 24, the first and second flow guide structures further include a plurality of third extension sections 4637C, 4637D vertically extending upward from the first and second inflow ports 4610, 4620 to the second extension sections 4634C, 4634D. The lower ends of the third extension sections 4637C, 4637D may extend to the first inflow port 4610 and the second inflow port 4620 to guide flow at the inflow ports, so that the uniform distribution of the air flow in the functional portion 4630 is further improved. The third extension sections 4637C in the first flow guide ribs correspond to the third extension sections 4637D in the fourth flow guide ribs, and the tips of the both are sealed with and resisted against each other. Preferably, the tips of the third extension sections 4637C and the third extension sections 4637D may be bonded; and, the third extension sections 4637C in the second flow guide ribs correspond to the third extension sections 4637D in the third flow guide ribs, and the tips of the both are sealed with and resisted against each other. Preferably, the tips of the third extension sections 4637C and the thirds extension sections 4637D may be bonded. The first air flow is guided upward from the first inflow port 4610 by the first flow guide structure, then obliquely flows into the first flow path 4601C, and continuously flows upward for discharging; and, the second air flow is guided upward from the second inflow port 4620 by the second flow guide structure, then obliquely flows into the second flow path 4601D, and continuously flows upward for discharging.

In addition, when the air flow enters the flow guide chambers, since the flow resistance near two side edges of the fog dissipation device 4601 is smaller, the air flow entering the plurality of flow guide chambers is uneven, so that the heat exchange efficiency of the air flow in the first flow path 4601C and the second flow path 4601D is effected relatively.

To solve the above technical problems, as shown in FIGS. 19, 23 and 24, in the fog dissipation device 4601 in this implementation, first slots 4635C for allowing the first air flow to pass therethrough are formed at the bottom ends of the first flow guide chambers formed between the plurality of first flow guide structures, and the rib spacing the plurality of first slots 4635C gradually increases from the edge of one section of the fog dissipation device 4601 to the center of the fog dissipation device 4601 in the width direction; and, second slots 4635D for allowing the second air flow to pass therethrough are formed at the bottom ends of the second flow guide chambers formed between the plurality of second flow guide structures, and the rib spacing of the plurality of second slots 4635D gradually increases from the edge of the other section of the fog dissipation device to the center of the fog dissipation device 4601 in the width direction. The smaller the rib spacing of the first slots 4635C close to the left side edge of the fog dissipation device 4601 is, the larger the flow resistance is; the larger the rib spacing the first slots 4635C away from the left side edge of the fog dissipation device 4601 is, the smaller the flow resistance is; the smaller the rib spacing of the second slots 4635D close to the right side edge of the fog dissipation edge 4601 is, the larger the flow resistance is; and, the larger the rib spacing the second slots 4635D away from the right side edge of the fog dissipation device 4601 in the width direction is, the smaller the flow resistance is. Thus, the air flow flowing from the plurality of first and second slots 4635C, 4635D enters the plurality flow guide chambers more evenly, and the heat exchange efficiency of the fog dissipation device 4601 is further improved.

Thus, the plurality of first flow guide structures and the plurality of second flow guide structures can prevent the air flow from directly flowing upward from the first and second inflow ports 4610, 4620, and guide the air flow to the approximately full width of the flow dissipation device 4601, so that the heat exchange efficiency of the fog dissipation device 4601 is improved.

Eighth Implementation

The fog dissipation device in this implementation further includes third flow guide structures, and the third flow guide structures occupy the approximately full width of the first flow guide chambers or the second flow guide chambers.

The composition structure of the third flow guide structures will be described below. As shown in FIGS. 20 and 22, a plurality of fifth flow guide ribs protruded to one side are formed on the surface of the first fog dissipation sheet C, and sixth flow guide ribs that are protruded to the other side and correspond to the fifth flow guide ribs are formed on the surface of the second fog dissipation sheet D. The fifth flow guide ribs and the sixth flow guide ribs have opposite protruding directions, and the tips of the both are resisted against each other. Preferably, the tips of the fifth flow guide ribs and the sixth flow guide ribs may be bonded.

The plurality of fifth flow guide ribs and sixth flow guide ribs may be strip-shaped protrusions 4636C, 4636D which are arranged in parallel and extend obliquely, and are used to distribute the air flow in each flow guide chamber into the approximately full width range of the flow guide chamber, so that the air flow is evenly distributed by each flow guide chamber and the heat exchange efficiency of the fog dissipation device is further improved.

Ninth Implementation

In this improvement, improvements are made to the fog dissipation device 1601 on the basis of the first implementation.

As shown in FIGS. 25-28, the fog dissipation device 1601 in this implementation includes first extension sections 1633C, 1633D and second extension sections 1634C, 1634D which are of the same structure in the seventh implementation.

Figure 26:
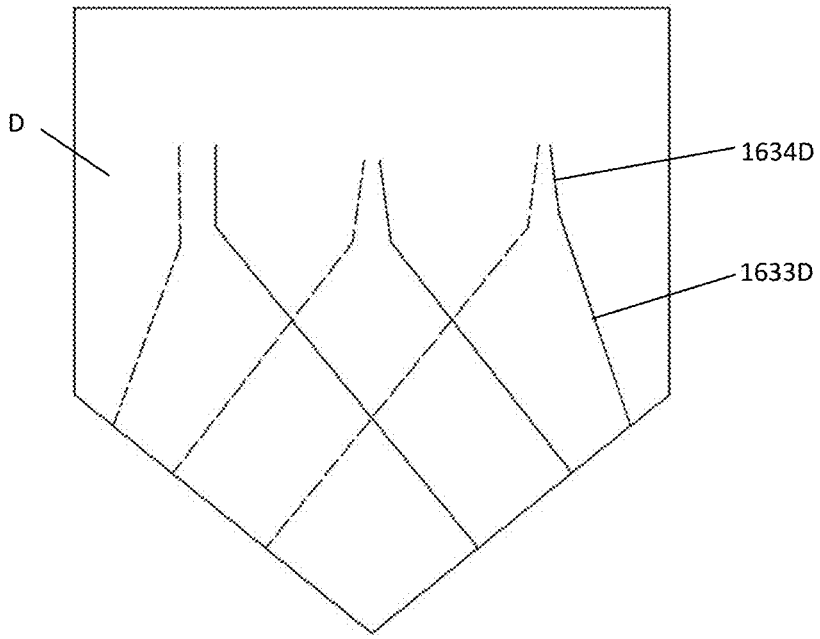
FIG. 26 is a front view of the second fog dissipation sheet in the fog dissipation device of one structure according to this implementation.

When the fog dissipation device is pentagonal, as shown in FIG. 12, the first ends of the first extension sections 1633C extend to the left bevel edge of the sharp corner, while the second ends thereof extend obliquely to the upper right. As shown in FIG. 26, the first ends of the first extension sections 1634D extend to the right bevel edge of the sharp corner, while the second ends thereof extend obliquely to the upper left. The first air flow is guided to the first inflow port by the first flow guide structure, then obliquely flows into the first flow path, and continuously flows upward for discharging; and, the second air flow is guided to the second inflow port by the second flow guide structure, then obliquely flows into the second flow path, and continuously flows upward for discharging.

Figure 27:
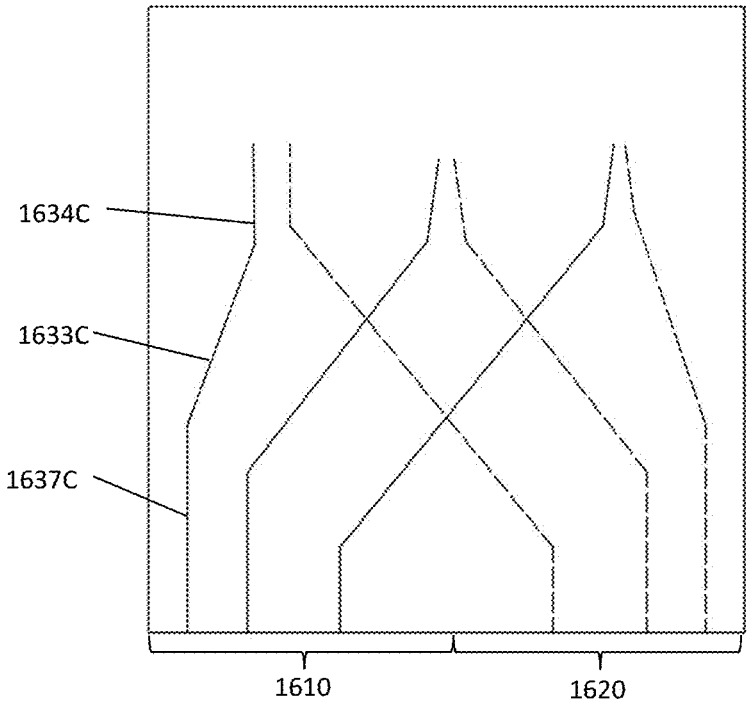
FIG. 27 is a front view of the first fog dissipation sheet in the fog dissipation device of another structure according to this implementation.
Figure 28:
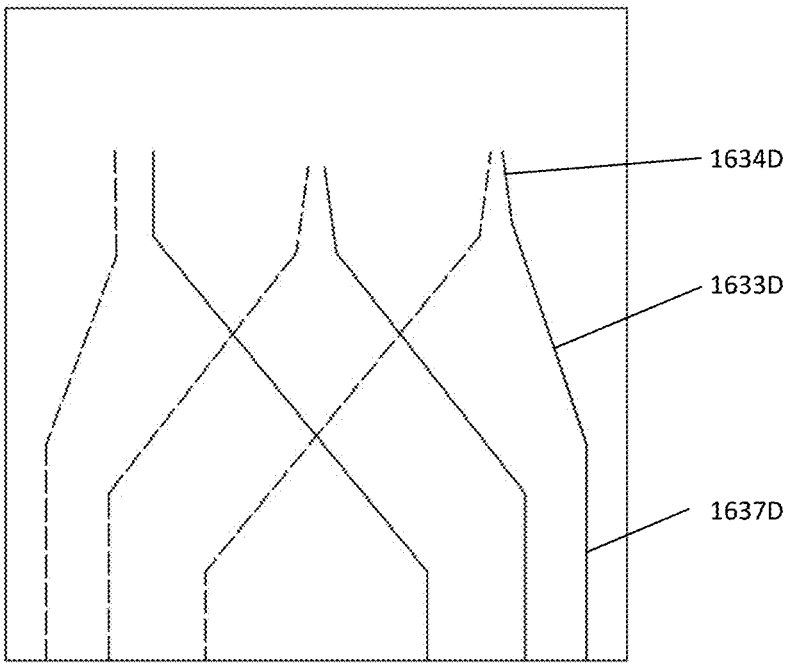
FIG. 28 is a front view of the second fog dissipation sheet in the fog dissipation device of another structure according to this implementation.

When the fog dissipation device is rectangular, as shown in FIGS. 27 and 28, the first and second flow guide structures further include a plurality of third extension sections 1637C, 1637D vertically extending upward from the first and second inflow ports 1610, 1620 to the second extension sections 1634C, 1634D. The first air flow is guided upward from the first inflow port 1610 by the first flow guide structure, then obliquely flows into the first flow path 1601C, and continuously flows upward for discharging; and, the second air flow is guided upward from the second inflow port 1620 by the second flow guide structure, then obliquely flows into the second flow path 1601D, and continuously flows upward for discharging.

It is to be noted that, the first and second flow guide structures in the seventh implementation and this implementation may only include first extension sections, and the upper ends of the first extension sections evenly divide the approximately full width of the fog dissipation device.

Tenth Implementation

Figure 29:
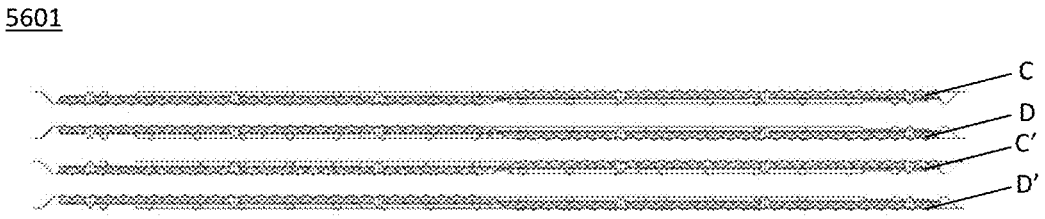
FIG. 29 is an exploded view of a portion of the fog dissipation device according to a tenth implementation.
Figure 30:
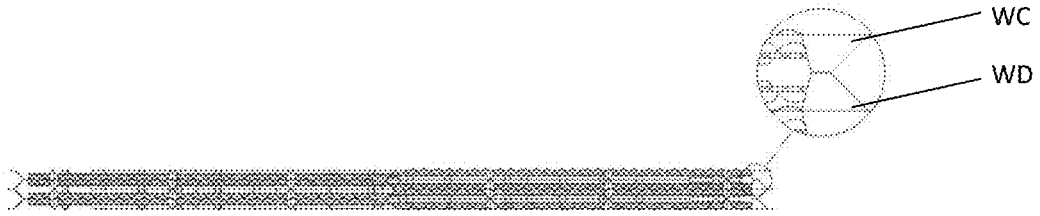
FIG. 30 is a side view of the fog dissipation device according to this implementation and a partially enlarged view thereof.
Figure 31:
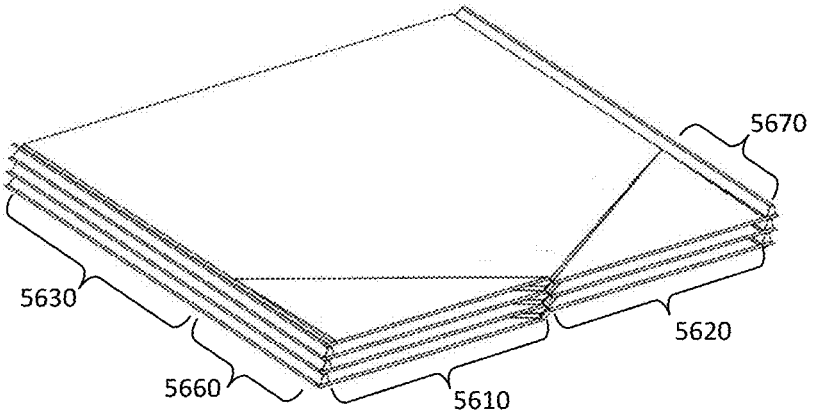
FIG. 31 is a partially stereoscopic view of the fog dissipation device according to this implementation.

FIG. 29 is an exploded view of a portion of the fog dissipation device 5601 in this implementation. FIG. 30 is a side view of the fog dissipation device 5601 after being stacked in this implementation and a partially enlarged view thereof. FIG. 31 is a partially stereoscopic view of the fog dissipation device 5601 in this implementation.

As shown in FIG. 29, in the process of stacking the fog dissipation device, stacking is performed in an order of the first fog dissipation sheet C, the second fog dissipation sheet D, the first fog dissipation sheet C', the second fog dissipation sheet D' . . . .

As shown in FIG. 30, concave bent portions WC are formed on the first fog dissipation sheets C, C' on one side, convex bent portions WD are formed on the second fog dissipation sheets D, D' on the other side, and the concave bent portions WC on the first fog dissipation sheets C, C' can be connected to the convex bent portions WD of the second fog dissipation sheets D, D'.

The following description will be given by taking the first fog dissipation sheet C and the second fog dissipation sheet D. As shown in FIGS. 30 and 31, two side edges of the first fog dissipation sheet D and the left bevel edge of the sharp corner of the functional portion are depressed downward from the plane where the substrate is located to form a bent portion WC. The bent portion WC is formed as a continuous slot, the section shape of the bent portion WC is preferably an inverted trapezoidal shape and the width of the slot top of the bent portion WC is greater than that of the slot bottom, but it is not limited thereto. Two side edges of the second fog dissipation sheet D and the left bevel edge of the sharp corner of the functional portion are protruded upward from the plane where the substrate is located to form a bent portion WD. This bent portion WD is formed as a continuous slot and the section shape of the bent portion WD is preferably a trapezoidal shape, but it is not limited thereto. The bending direction of the bent portion WC of the first fog dissipation sheet C is opposite to that of the bent portion WD of the second fog dissipation sheet D. When the first fog dissipation sheet C and the second fog dissipation sheet D are stacked, the top end of the bent portion WC is connected to the top end of the bent portion WD in a sealed manner. Preferably, the outer surface of the slot bottom of the bent portion WC is bonded to the outer surface of the slot bottom of the bent portion WD, so that the sealing and fixation between the bent portion WC and the bent portion WD are realized, and the stacked first flow path and second flow path are formed between the stacked first fog dissipation sheet C and second fog dissipation sheet D.

The bent portions WC located on two side edges of the first fog dissipation sheet C extend to the lower end from the upper end of the first fog dissipation sheet C, and the bent portions WD located on two side edges of the second fog dissipation sheet D extend to the lower end from the upper end of the second fog dissipation sheet D. Further, the first import portion 5660 and the second import portion 5670 are occluded laterally to form the first inflow port 5610 and the second inflow port 5620.

Eleventh Implementation

During manufacturing, mounting or operation, the junctions of the side edges of the first fog dissipation sheet C and the second fog dissipation sheet D may not be tight, resulting in the appearance of undesirable water and/or air flow paths.

Figure 32:
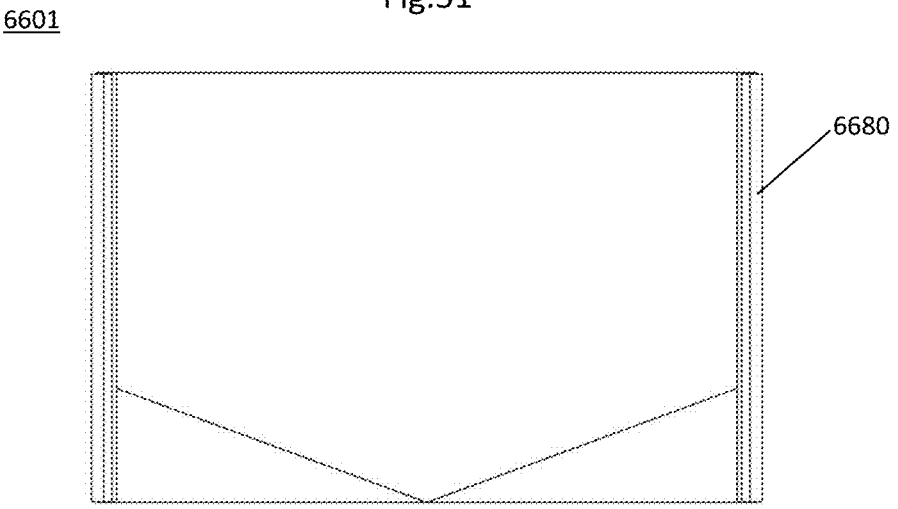
FIG. 32 is a front view of the fog dissipation device according to an eleventh implementation.
Figure 33:
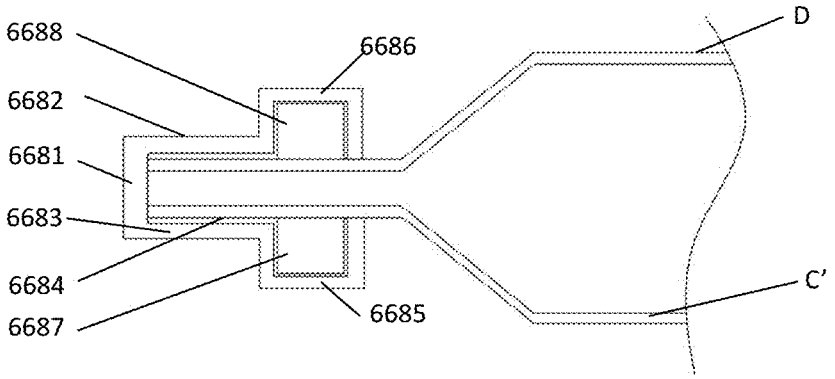
FIG. 33 is a connection diagram of the side sealing member and the fog dissipation sheet according to this implementation.
Figure 34:
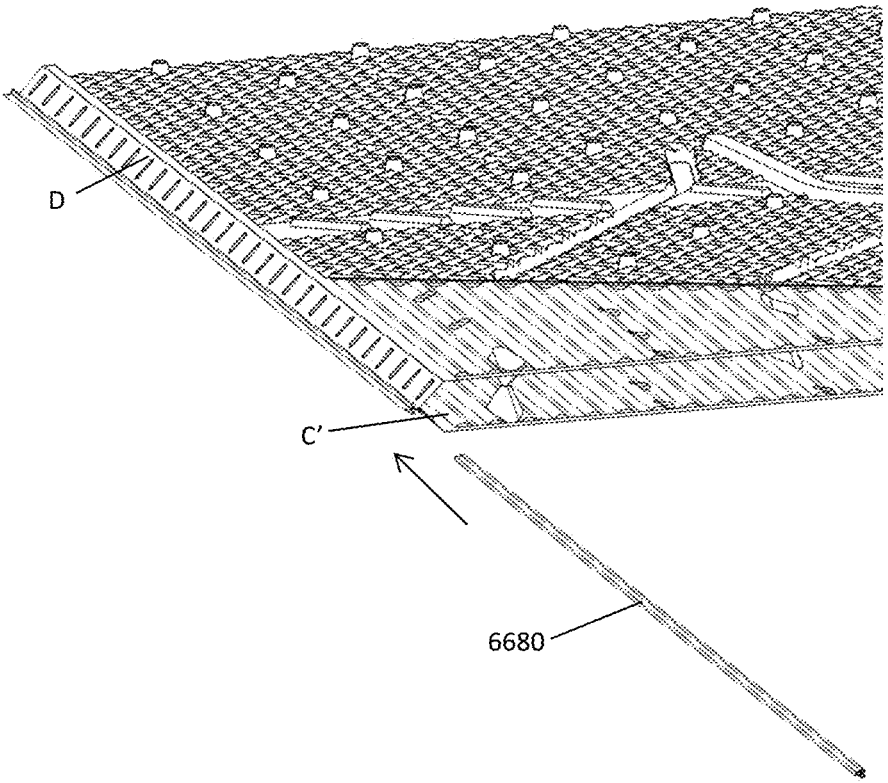
FIG. 34 is a mounting diagram of the side sealing member according to this implementation.

To solve the above technical problems, as shown in FIGS. 32-34, the fog dissipation device 6601 in this implementation further includes side sealing members 6680.

By taking the second fog dissipation sheet D and the first fog dissipation sheet C', the side sealing members 6680 can further compress and seal the gaps between the side fitting surfaces of the first fog dissipation sheet C' and the second fog dissipation sheet D, thus avoiding the generation of undesirable water and/or air flow paths. In this implementation, side sealing members for covering the gaps between the first fog dissipation sheet C' and the adjacent second fog dissipation sheet D are arranged on two side edges of the fog dissipation device 6601.

As shown in FIG. 33, each of the side sealing member 6680 includes a sealing sheet 6681, and a first sealing portion 6682 and a second sealing portion 6683 that are formed on two side edges of the sealing sheet 6681, respectively. The first sealing portion 6682 and the second sealing portion 6683 extend to the same side of the sealing sheet 6681. A pull slot 6684 is formed between the first sealing portion 6682 and the second sealing portion 6683. The side sealing member 6680 further includes a first slot structure 6685 and a second slot structure 6686. The openings of the first slot structure 6685 and the second slot structure 6686 are opposite to each other, the left wall of the first slot structure 6685 is connected to the second sealing portion 6685, and the left wall of the second slot structure 6686 is connected to the first sealing portion 6682. The first slot structure 6685, the sealing sheet 6681 and the second sot structure 668 may be formed by continuously bending the substrate. The side sealing members 6680 occupy the approximately full height of the first and second fog dissipation sheets C', D. First protruded strips protruded to one side are formed on two side edges of the first fog dissipation sheet C', and second protruded strips 6688 protruded to the other side are formed on two side edges of the second fog dissipation sheet D. The first protruded strips 6687 extend in the height direction of the first fog dissipation sheet C', and occupy the approximately full height of the first fog dissipation sheet C'. The second protruded strips 6688 extend in the height of the second fog dissipation sheet D, and occupy the approximately full height of the second fog dissipation sheet D. To enhance the connection strength of the side sealing members 6680, the first protruded strips 6687 and the second protruded strips 6688 are arranged close to the root of the junction of the first fog dissipation sheet C' with the adjacent second fog dissipation sheet D. During mounting, the bottom ends of the first protruded strips 6687 and the second protruded strips 6688 are arranged in the first slot structure 6685 and the second slot structure 6686, respectively, the remaining portions thereof are arranged in the pull slots 6684, respectively, and the side sealing members 6680 are sleeved in the height direction of the first and second fog dissipation sheets C', D, until the first protruded strips 6687 and the second protruded strips 6688 are completely arranged in the first slot structure 6685 and the second slot structure 6686, respectively. Thus, the water droplets formed on the fog dissipation sheets or the air outside the flow paths can be blocked by the side sealing members 6680, so that the sealing performance of the flow paths is further improved.

Twelfth Implementation

During manufacturing, mounting or operation, the junctions on the bottoms of the deflected portions PC of the first fog dissipation sheets C, C' and the deflected portions PD of the second fog dissipation sheets D, D' may not be tight, resulting in the appearance of undesirable water and/or air flow paths.

Figure 35:
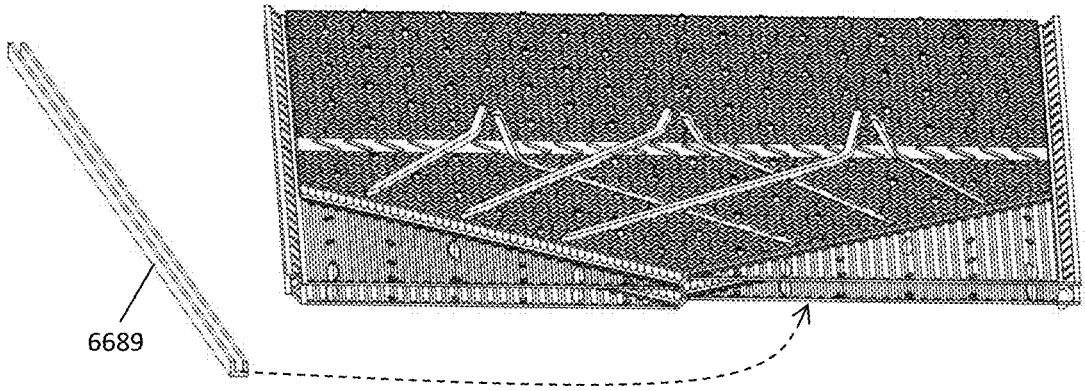
FIG. 35 is a mounting diagram of the bottom sealing member and the fog dissipation sheet according to a twelfth implementation.

To solve the above technical problems, as shown in FIG. 35, the fog dissipation device in this implementation further includes bottom sealing members 6689. The bottom sealing members 6689 can further compress and seal the gaps between the bottom fitting surfaces of the deflected portions PC and the deflected portions PD, thus avoiding the generation of undesirable water and/or air flow paths.

As shown in FIG. 35, the bottom sealing members 6689 are generally U-shaped slots. During mounting, the bottom junctions of the deflected portions PC and the deflected portions PD may be arranged in the slots, and two sides of the U-shaped slots are fitted with the stacked first fog dissipation sheets C, C' and second fog dissipation sheets D, D', respectively. The bottom sealing members 6689 are mounted by a compression tool to occlude the gaps between the bottoms of the deflected portions PC and the deflected portions PD, so that the sealing performance of the first fog dissipation sheets C, C' and the second fog dissipation sheets D, D' is further improved.

Thirteenth Implementation

In this implementation, further improvements are made to the fog device with a horizontal bottom, wherein a sealing structure is stacked between the stacked first inflow port and second inflow port, thereby further preventing the dry cold wind or wet hot air from entering the adjacent inflow port and affecting heat exchange.

Figure 36:
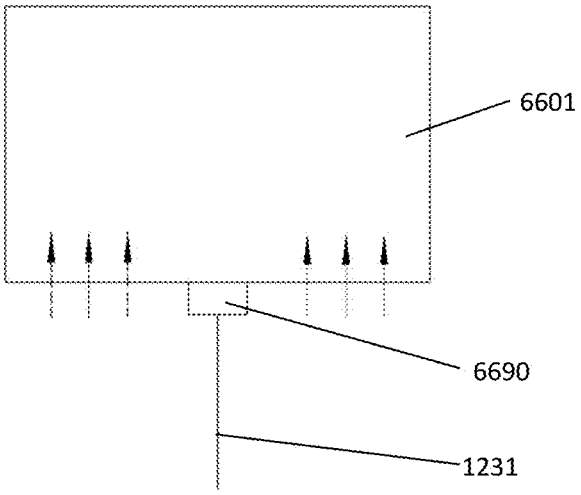
FIG. 36 is a connection diagram of the fog dissipation device, the sealing member and the partition plate according to a thirteenth implementation.

In this implementation, as shown in FIG. 36, a sealing member 6690 extending in the stacking direction is arranged on the lower side of the fog dissipation device and between the first inflow port and the second inflow port. The sealing member 6690 is a flexible member, preferably rubber or sponge. During mounting, the sealing member 6690 is pre-mounted (by gluing or in other ways) on the lower side of the fog dissipation device 6601. When the fog dissipation device 6601 is arranged on the partition plate 1231, the sealing member 6690 is squeezed by the gravity of the fog dissipation device 6601, so that the sealing member 6690 is deformed to enhance the sealing performance between the partition plate 1231 and the adjacent inflow port, thereby avoiding the appearance of undesirable water and/or air flow paths.

It is to be noted that, the sealing member 6690 may be in strip-shaped with a rectangular section, or may also be matched with the specific shape of the bottom edge of the fog dissipation device 6601 and the partition plate 1231, thereby ensuring the sealing effect of the sealing member 6690 with the fog dissipation device 6601 and the partition plate 1231.

Fourteenth Implementation

The actual fog dissipation device is formed by stacking a plurality of fog dissipation sheets and is heavy, so it is inconvenient to move manually during field mounting.

Figure 37:
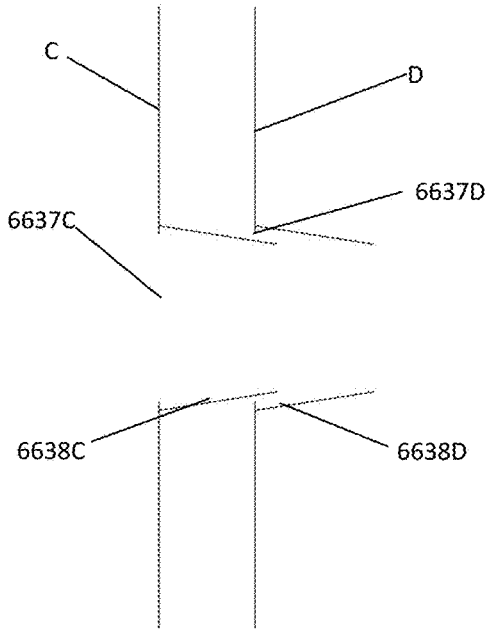
FIG. 37 is a side view of the connection structures of the first fog dissipation sheet and the second dissipation sheet according to a fourteenth implementation.
Figure 38:
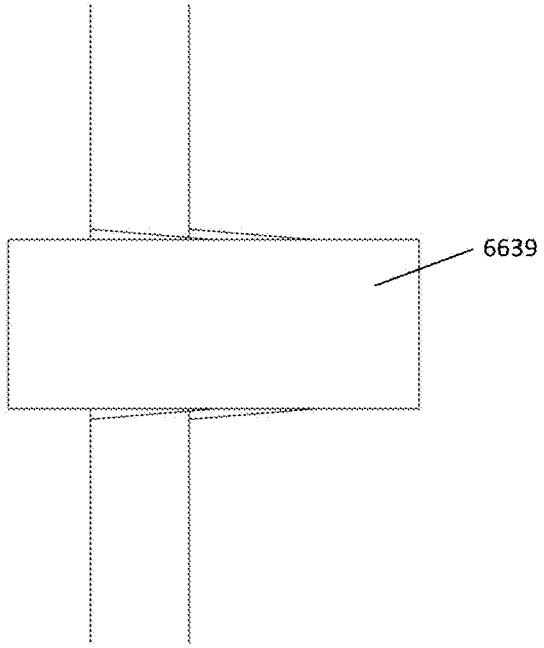
FIG. 38 is a connection diagram of the mounting tube, the first fog dissipation sheet and the second fog dissipation sheet according to this implementation.
Figure 39:
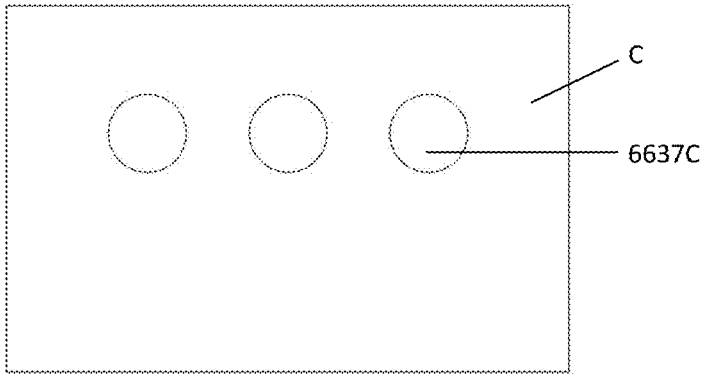
FIG. 39 is a front view of the first fog dissipation sheet according to this implementation.

FIG. 37 is a side view of the connection structure of the first fog dissipation sheet C and the second dissipation sheet D; FIG. 38 is a connection diagram of the mounting tube 6639, the first fog dissipation sheet C and the second fog dissipation sheet D; and, FIG. 39 is a front view of the first fog dissipation sheet C.

To solve the above technical problems, the fog dissipation device in this implementation will be described by taking stacking the first fog dissipation sheet C and the second fog dissipation sheet D as an example. As shown in FIGS. 37 and 38, at least one straight-through first mounting hole 6637C is formed on the first fog dissipation sheet C, and at least one second mounting hole 6637D corresponding to the first mounting hole 6637C is formed on the second fog dissipation sheet D. A first bump 6638C is formed on one side of the first fog dissipation sheet C, and the first bump 6638C extends from the right side of the first fog dissipation sheet C toward the stacking direction. A second bump 6638D is formed on one side of the second fog dissipation sheet D, and the second bump 6638D extends from the right side of the second fog dissipation sheet D toward the stacking direction. The outer diameter of the first bump 6638C extending in the stacking direction gradually decreases, that is, the first bump 6638C is in shape of a hollow circular truncated cone as a whole. The outer diameter of the end of the first bump 6638C away from the first fog dissipation sheet C is less than the inner diameter of the second mounting hole 6637D, and the outer diameter of the end of the first bump 6638C close to the first fog dissipation sheet C is slightly greater than the inner diameter of the second mounting hole 6637D. When the first fog dissipation sheet C and the second fog dissipation sheet D are stacked, the outer surface of the first bump 6638C is fitted with the inner surface of the second mounting hole 6637D. Corresponding, the outer diameter of the second bump 6638D extending in the stacking direction gradually decreases, that is, the second bump 6638D is in shape of a hollow circular truncated cone as a whole. The outer diameter of the end of the second bump 6638D away from the second fog dissipation sheet D is less than the inner diameter of the first mounting hole 6637C, and the outer diameter of the end of the second bump 6638D close to the second fog dissipation sheet D is slightly greater than the inner diameter of the first mounting hole 6637C. Similarly, when the second fog dissipation sheet C and the first fog dissipation sheet C' are stacked, the outer surface of the second bump 6638D is fitted with the inner surface of the first mounting hole 6637C . . . . A mounting tube 6639 is penetrated through the fog dissipation device. The end of the mounting tube 6639 successively passes through the first mounting hole 6637C, the second bump 6638D, the second mounting hole 6637D and the second bump 6638D which are stacked, so that the first bump 6638C and the second mounting 6637D are squeezed to form a sealed connection, without affecting the heat exchange of the air flow in the flow path. The length of the mounting tube 6638 is greater than that of the fog dissipation device to reverse an operation space, for example, a manual moving space or an operation space of a lifting device (e.g., a screw jack, a pulley block, a hydraulic cylinder, etc.).

It is to be noted that, the number of the first and second mounting holes 6637C, 6637D may be adjusted according to the dimension of the fog dissipation device, but the arrangement of the first and second mounting holes 6637C, 6637D needs to be set according to the position of the center of gravity of the first fog dissipation sheet C and the second fog dissipation sheet D. for example, when only one first mounting hole 6637C is formed on the first fog dissipation sheet C, the first mounting hole 6637C is formed above the center of gravity of the fog dissipation device; when two first mounting holes 6637C are formed on the first fog dissipation sheet C, the two first mounting holes 6657C are formed above the center of gravity of the fog dissipation device and symmetrical about the action line of gravity; and, when three first mounting holes 6637C are formed on the first fog dissipation sheet C, the three first mounting holes 6637C are formed above the center of gravity of the first fog dissipation sheet C and located on the same horizontal line, the middle first mounting hole 6637C is located on the action line of gravity of the first fog dissipation sheet C, and two first mounting holes 6637C on two sides are symmetrical about the action line of gravity . . . . Correspondingly, the number of second mounting holes 6637D is the same as the number of the first mounting holes 6637C and the hole positions correspond to each other, so that it is convenient for the passage of the mounting tube 6639.

Fifteenth Implementation

Figure 40:
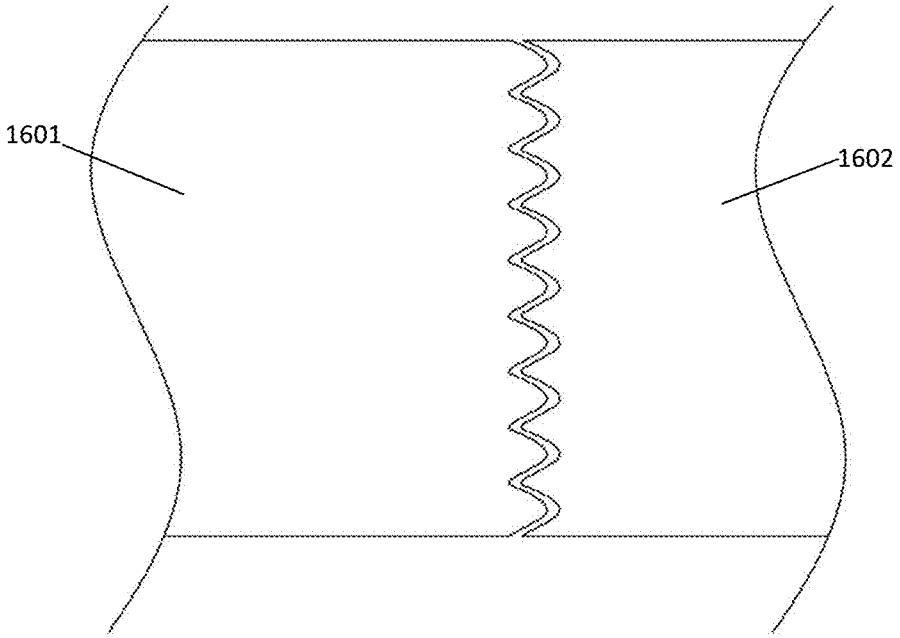
FIG. 40 is a connection diagram of a fog dissipation device and an adjacent fog dissipation device according to a fifteenth implementation.

As shown in FIG. 40, in the cooling tower in this implementation, the side edges of the fog dissipation devices may be concave-convex edges, which are meshed with the concave-convex edges of adjacent fog dissipation devices, to further enhance the operation stability and sealing performance of the fog dissipation device.

Specifically, the orthographic projections of two concave-convex edges of the fog dissipation device 1601 are preferably sine waves, but it is not limited thereto. After adjacent fog dissipation devices are mounted and spliced, the splicing surfaces are concave-convex and meshed with each other, that is, peaks are arranged in troughs, thereby realizing close fitting. Preferably, glue may be coated on the concave-convex splicing surfaces to enhance the firmness and tightness of splicing.

Sixteenth Implementation

As shown in FIG. 2, the top edges of the plurality of fog dissipation devices of the fog dissipation portion 1600 are formed as horizontal straight edges. The dry warm wind curtain and the wet warm air curtain flow upward and are mixed quickly.

Figure 41:
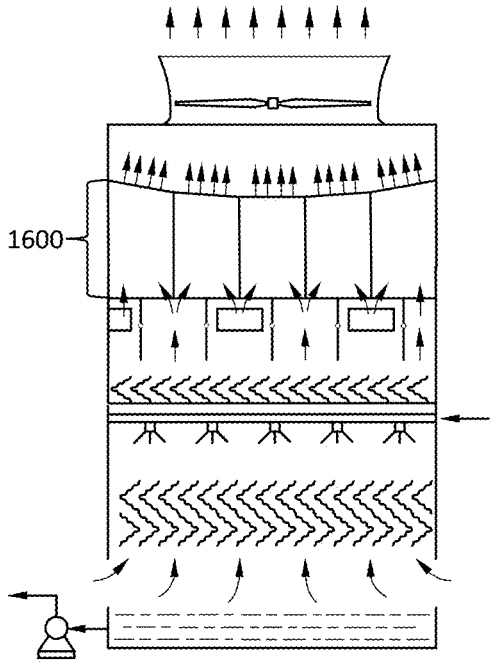
FIG. 41 is a sectional elevation view of the cooling tower according to a sixteenth implementation, where the top edges of the fog dissipation devices are a combination of horizontal straight edges and inclined straight edges.

As shown in FIG. 41, the top edges of the plurality of fog dissipation devise of the fog dissipation portion 1600 in this implementation may also be inclined straight edges or a combination of inclined straight edges and horizontal straight edges. That is, the top edge of the fog dissipation device on the left of the center line of the cooling tower is inclined to the lower right from the left side of the fog dissipation device, the top edge of the fog dissipation device on the right of the center line of the cooling tower is inclined to the lower left from the right side of the fog dissipation device, and the top edge of the fog dissipation device in the middle of the cooling tower may be a horizontal straight line, so that the dry warm wind curtain and the wet ward curtain flow toward the draught fan, thereby reducing the vortex in the air chamber and reducing the energy consumption of the draught fan.

Figure 42:
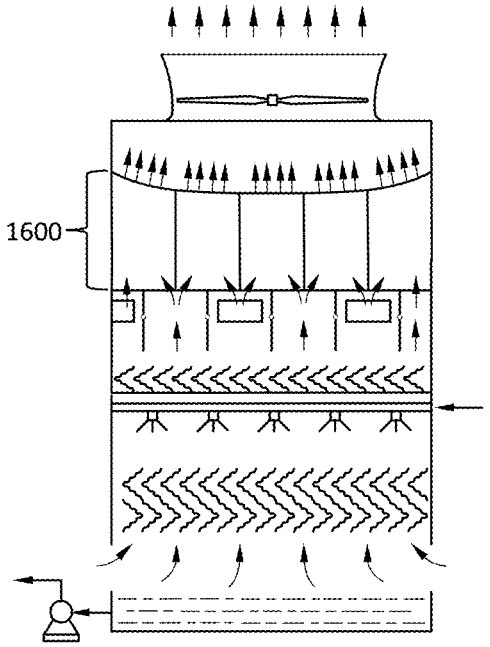
FIG. 42 is a sectional elevation view of the cooling tower according to this implementation, where the top edges of the fog dissipation devices are curved edges.

As shown in FIG. 42, the top edges of the fog dissipation devices may also be curved edges. The curved shape adapts to the flow field of the rectified inlet air of the draught fan, thereby reducing the vortex in the air chamber and reducing the energy consumption of the draught fan.

The invention claimed is:

1. A fog dissipation device, comprising:

a first flow path and a second flow path which are stacked in a stacking direction to exchange heat between a first air flow and a second air flow flowing from a lower side of the fog dissipation device to an upper side of the fog dissipation device; and first fog dissipation sheets and second fog dissipation sheets alternately stacked in the stacking direction, wherein the first flow path is defined by a first fog dissipation sheet of the first fog dissipation sheets and a second fog dissipation sheet of the second fog dissipation sheets adjacent to the first fog dissipation sheet, and the second flow path is defined by the second fog dissipation sheet and a further first fog dissipation sheet of the first fog dissipation sheets adjacent to the second fog dissipation sheet;

a first inflow port, at the lower side, configured to guide the first air flow into the first flow path;

a second inflow port, at the lower side, configured to guide the second air flow into the second flow path;

a first outflow port through which the first air flow flowing out of the first flow path is discharged from the upper side; and a second outflow port through which the second air flow flowing out of the second flow path is discharged from the upper side; wherein the first outflow port and the second outflow port are alternately stacked, a width of the first outflow port is approximately the same as that of the fog dissipation device and greater than a width of the first inflow port in a width direction perpendicular to the stacking direction, and a width of the second outflow port is approximately the same as that of the fog dissipation device and greater than a width of the second inflow port in the width direction.

2. The fog dissipation device according to claim 1, wherein, a top edge of the fog dissipation device is a horizontal straight edge, or an inclined straight edge having a certain included angle with the horizontal direction.

3. The fog dissipation device according to claim 1, wherein, a top edge of the fog dissipation device is formed as a curved edge.

4. The fog dissipation device according to claim 1, wherein, the lower side of the fog dissipation device forms a sharp corner with a downward tip.

5. The fog dissipation device according to claim 1, wherein, the lower side of the fog dissipation device is formed horizontally.

6. The fog dissipation device according to claim 5, wherein, a width dimension of the fog dissipation device consists of two sections;

a first import portion communicated with the first flow path is formed in one section of a bottom width of the fog dissipation device; and a second import portion communicated with the second flow path is formed in the other section of the bottom width of the fog dissipation device.

7. The fog dissipation device according to claim 6, wherein, a bottom width edge of the first import portion is the same as that of a bottom edge of the second import portion.

8. The fog dissipation device according to claim 6, wherein, a bottom width edge of the first import portion is different from that of a bottom edge of the second import portion.

9. The fog dissipation device according to claim 8, wherein, when the bottom width edge of the first import portion is less than that of the bottom edge of the second import portion, an included angle between a bevel edge of the first import portion on an outflow side is greater than an included angle between a bevel edge of the second import portion on an outflow side and a horizontal plane.

10. The fog dissipation device according to claim 8, wherein, when the bottom width edge of the first import portion is greater than that of the bottom edge of the second import portion, an included angle between a bevel edge of the first import portion on an outflow side is less than an included angle between a bevel edge of the second import portion on an outflow side and a horizontal plane.

11. The fog dissipation device according to claim 8, wherein, a thickness of the first inflow port of the first import portion is greater than that of the first outflow port in the stacking direction; and a thickness of the second inflow port of the second import portion is greater than that of the second outflow port in the stacking direction.

12. The fog dissipation device according to claim 6, wherein, a first transition portion is formed between the first import portion and the first flow path; and a second transition portion is formed between the second import portion and the second flow path.

13. The fog dissipation device according to claim 12, wherein, a thickness of the first transition portion gradually decreases from the first inflow port to the first outflow port in the stacking direction; and a thickness of the second transition portion gradually decreases from the second inflow port to the second outflow port in the stacking direction.

14. The fog dissipation device according to claim 13, wherein, the thickness of the inflow port of the first transition portion is greater than that of the inflow port of the first flow path, and the thickness of the outflow port of the first transition portion is less than that of the outflow port of the first import portion; and the thickness of the inflow port of the second transition portion is greater than that of the inflow port of the second flow path, and the thickness of the outflow port of the second transition portion is less than that of the outflow port of the second import portion.

15. The fog dissipation device according to claim 14, wherein, first connection portions folded from the outflow port of the first import portion to opposite directions are formed on the first fog dissipation sheets and the second fog dissipation sheets, and the first transition portion is formed between the first connection portions;

second connection portions folded from the outflow port of the second import portion to opposite directions are formed on the first fog dissipation sheets and the second fog dissipation sheets, and the second transition portion is formed between the second connection portions; and the first and second connection portions are formed to bend a substrate at least one time to form a concave-convex shape.

16. The fog dissipation device according to claim 15, wherein, at least one bending point is formed on a first connection portion of the first connection portions, and in the first transition portion, the thickness between the bending points on the first fog dissipation sheets and the corresponding bending points on the second fog dissipation sheets is less than that of the inflow port of the first transition portion and greater than that of the outflow port of the first transition portion; and at least one bending point is formed on a second connection portion of the second connection portions, and in the second transition portion, the thickness between the bending points on the first fog dissipation sheets and the corresponding bending points on the second fog dissipation sheets is less than that of the inflow port of the second transition portion and greater than that of the outflow port of the second transition portion.

17. The fog dissipation device according to claim 16, wherein, the first connection portion is divided into two portions by the bending point on the first connection portion, and the included angle between the portion close to the inflow port of the first transition portion and the horizontal plane is greater than the portion close to the outflow portion of the first transition portion and the horizontal plane; and the second connection portion is divided into two portions by the bending point on the second connection portion, and the included angle between the portion close to the inflow port of the second transition portion and the horizontal plane is greater than the portion close to the outflow portion of the second transition portion and the horizontal plane.

18. The fog dissipation device according to claim 15, wherein, in the first transition portion, a plurality of downflow grooves are formed on the first connection portions on the first fog dissipation sheets, and a plurality of downflow grooves are also formed on the first connection portions on the second fog dissipation sheets stacked with the first fog dissipation sheets; and in the second transition portion, a plurality of downflow grooves are formed on the second connection portions on the first fog dissipation sheets, and a plurality of downflow grooves are also formed on the second connection portions on the second fog dissipation sheets stacked with the first fog dissipation sheets.

19. The fog dissipation device according to claim 5, wherein, the inflow port of the first flow path is formed in one section of the lower side of the fog dissipation device in the width direction; and the inflow port of the second flow path is formed in the other section of the lower side of the fog dissipation device in the width direction.

20. The fog dissipation device according to claim 4, having:

a first flow guide structure for guiding the first air flow flowing from one section of a bottom width of the fog dissipation device to an approximately full width range of the fog dissipation device; and/or a second flow guide structure for guiding the second air flow flowing from the other section of the bottom width of the fog dissipation device to the approximately full width range of the fog dissipation device.

21. The fog dissipation device according to claim 20, wherein, the fog dissipation device is divided into a plurality of independent first flow chambers by the first flow guide structure, and the plurality of first flow chambers occupy the approximately full width of the fog dissipation device; and/or the fog dissipation device is divided into a plurality of independent second flow chambers by the second flow guide structure, and the plurality of second flow chambers occupy the approximately full width of the fog dissipation device.

22. The fog dissipation device according to claim 21, wherein, first slots for allowing the first air flow to pass therethrough are formed at bottom ends of the first flow chambers, and a rib spacing of the plurality of first slots gradually increases from an edge of one section of the width of the fog dissipation device to the center of the fog dissipation device in the width direction; and/or second slots for allowing the second air flow to pass therethrough are formed at bottom ends of the second flow chambers, and a rib spacing of the plurality of second slots gradually increases from an edge of the other section of the width of the fog dissipation device to the center of the fog dissipation device in the width direction.

23. The fog dissipation device according to claim 21, wherein, a plurality of first flow guide ribs protruded to one side and a plurality of second flow guide ribs protruded to the other side are formed on the surfaces of the first fog dissipation sheets; and/or third flow guide ribs that are protruded to one side and correspond to the second flow guide ribs and fourth flow guide ribs that are protruded to the other side and correspond to the first flow guide ribs are formed on the surfaces of the second fog dissipation sheets, wherein the first and second flow guide structures are formed in such a way that tips of the first flow guide ribs are connected to tips of the fourth flow guide ribs in a sealed manner and tips of the second flow guide ribs are connected to tips of the third flow guide ribs in a sealed manner.

24. The fog dissipation device according to claim 23, wherein, the first, second, third and fourth flow guide ribs comprise a plurality of first extension sections extending obliquely.

25. The fog dissipation device according to claim 24, wherein, the first, second, third and fourth flow guide ribs further comprise second extension sections bent upward from the first extension sections.

26. The fog dissipation device according to claim 25, wherein, the first, second, third and fourth flow guide ribs further comprise third extension sections bent downward from bottom ends of the first extension sections.

27. The fog dissipation device according to claim 20, wherein, an upper end of the first flow guide structure extends upward to the first outflow port; and/or an upper end of the second flow guide structure extends upward to the second outflow port.

28. The fog dissipation device according to claim 21, wherein, third flow guide structures are formed in first flow guide chambers and/or second flow guide chambers, and the third flow guide structures consist of a plurality of strip-shaped protrusions extending obliquely.

29. The fog dissipation device according to claim 1, wherein, a seal fit portion is formed on an edge of the fog dissipation device where no inflow/outflow port is formed, to form the first flow path and the second flow path.

30. The fog dissipation device according to claim 29, wherein, the seal fit portion is formed in such a way that:

concave bent portions are formed on the first fog dissipation sheets on one side, convex bent portions are formed on the second fog dissipation sheets on the other side, and the concave bent portions on the first fog dissipation sheets connect to the convex bent portions of the second fog dissipation sheets.

31. The fog dissipation device according to claim 1, wherein, the fog dissipation device further comprises side sealing members, and the side sealing members are arranged on two side edges of the fog dissipation device to cover gaps between the first fog dissipation sheets and adjacent second fog dissipation sheets.

32. The fog dissipation device according to claim 31, wherein, buckling structures are formed on two side edges of the fog dissipation device, and the side sealing members are buckled and connected to the buckling structures.

33. The fog dissipation device according to claim 32, wherein, the buckling structures are formed in such a way that:

first protruded strips protruded to one side are formed on two side edges of the first fog dissipation sheets, second protruded strips protruded to the other side are formed on two side edges of the second fog dissipation sheets, and groove structures matched with the first and second protruded strips are formed on the side sealing members.

34. The fog dissipation device according to claim 1, wherein, bottom sealing members for covering gaps between the first fog dissipation sheets and adjacent second fog dissipation sheets are arranged in one section or the other section of a bottom width of the fog dissipation device.

35. The fog dissipation device according to claim 1, wherein, at least one straight-through first mounting hole is formed on the first fog dissipation sheets, and at least one second mounting hole corresponding to the first mounting hole is formed on the second fog dissipation sheets stacked with the first fog dissipation sheets;

first bumps are formed on one side of the first fog dissipation sheets in a stacking direction, second bumps are formed on one side of the second fog dissipation sheets in the stacking direction, and the outer surfaces of the first bumps are fitted with the inner surfaces of the first mounting holes; and a mounting tube runs through the first bumps and the second bumps.

36. The fog dissipation device according to claim 35, wherein, the outer diameter of the first bumps extending in the stacking direction gradually decreases, and the outer diameter of the second bumps extending in the stacking direction gradually decreases.

37. A cooling tower, comprising:

fog dissipation devices, each fog dissipation device of the fog dissipation devices according to claim 1, the fog dissipation devices being arranged in a horizontal direction to form a fog dissipation portion of the cooling tower.

38. The cooling tower according to claim 37, wherein, two side edges of the fog dissipation devices are formed as concave-convex edges, which are meshed with the concave-convex edges of adjacent fog dissipation devices.

39. The cooling tower according to claim 37, wherein, partition plates are arranged on the lower side of the fog dissipation portion and on the bottom of said each fog dissipation device, and the plurality of partition plates are separated to form a plurality of air flow tunnels.

40. The cooling tower according to claim 39, wherein, sealing members extending in the stacking direction are arranged at junctions of the fog dissipation devices with the partition plates.

41. The fog dissipation device according to claim 1, wherein the width of the first inflow port is greater than the width of the second inflow port.

42. The fog dissipation device according to claim 41, wherein the first fog dissipation sheets and the second fog dissipation sheets are in a shape of a pentagon wherein a tip of the pentagon faces the lower side.

* * * * *